US011780664B2

(12) United States Patent
Cabouli

(10) Patent No.: US 11,780,664 B2
(45) Date of Patent: Oct. 10, 2023

(54) WIRELESS CONTROLLED LOCKING JAR WITH INTEGRATED VACUUM PUMP

(71) Applicant: Steven D. Cabouli, San Diego, CA (US)

(72) Inventor: Steven D. Cabouli, San Diego, CA (US)

( * ) Notice: Subject to any disclaimer, the term of this patent is extended or adjusted under 35 U.S.C. 154(b) by 33 days.

(21) Appl. No.: 17/561,911

(22) Filed: Dec. 24, 2021

(65) Prior Publication Data

US 2022/0135312 A1 May 5, 2022

Related U.S. Application Data

(63) Continuation-in-part of application No. 16/540,136, filed on Aug. 14, 2019, now Pat. No. 11,352,179.

(51) Int. Cl.
*B65D 81/20* (2006.01)
*B65D 55/14* (2006.01)
*B65D 43/02* (2006.01)

(52) U.S. Cl.
CPC ..... *B65D 81/2038* (2013.01); *B65D 43/0231* (2013.01); *B65D 55/14* (2013.01); *B65D 81/2015* (2013.01); *B65D 2255/00* (2013.01); *B65D 2543/00537* (2013.01)

(58) Field of Classification Search
CPC .. B65D 55/14; B65D 45/327; B65D 2251/20; B65D 2543/00953; B65D 2203/12; B65D 43/06; G07C 9/37; G07C 9/257; G07C 9/00563; G07C 2209/40; G07C 2209/60; G07C 9/00182; G07C 9/00912; F04B 37/14; F04B 17/06; C04B 19/04
USPC ..... 340/5.1; 141/65
See application file for complete search history.

(56) References Cited

U.S. PATENT DOCUMENTS 4,372,096 A * 2/1983 Baum ..... B67B 3/24 53/103
5,765,608 A * 6/1998 Kristen ..... B65B 31/047 141/96
6,382,416 B1 * 5/2002 Gainey ..... A61J 1/1437 206/317
7,021,034 B2 * 4/2006 Higer ..... B65B 31/00 53/512
7,048,136 B2 * 5/2006 Havens ..... B65D 51/1644 222/509

(Continued)

FOREIGN PATENT DOCUMENTS

CA 2975150 A1 * 2/2019

*Primary Examiner* — Nam V Nguyen
(74) *Attorney, Agent, or Firm* — Richard D. Clarke

(57) ABSTRACT

This application is directed to a Wireless Controlled Locking Jar with Integrated Vacuum Pump. More particularly, this application provides a wireless controlled lock on a jar lid having a built-in electrically powered vacuum pump and lid gasket which acts to lock the jar from unauthorized access by pulling a vacuum within the jar making it impossible to open the lid. The locking jar may be used to keep contents secure and fresh, and also out of the reach of children or other unauthorized individuals as it employs the user's Wi-Fi connected or Bluetooth paired smartphone or other device, in combination with a smartphone or other device software application, to lock and open the jar and allow access to the contents inside. By using the paired device and software application, the jar may be locked and unlocked by the user from any location.

20 Claims, 12 Drawing Sheets

(56) References Cited

U.S. PATENT DOCUMENTS

| | | | | |
|---|---|---|---|---|
| 8,488,314 | B1 * | 7/2013 | Ashcraft | G06F 1/1616 361/679.02 |
| 8,907,794 | B2 * | 12/2014 | Estevez | G07C 9/00896 70/57.1 |
| 9,878,821 | B2 * | 1/2018 | Sibley | B65B 31/00 |
| 9,911,261 | B2 * | 3/2018 | Gordon | G07C 9/37 |
| 10,894,643 | B2 * | 1/2021 | Leary | A47G 19/2227 |
| 11,352,179 | B2 * | 6/2022 | Cabouli | G07C 9/00912 |
| 2005/0129535 | A1 * | 6/2005 | Beyer | F04B 49/00 416/61 |
| 2017/0281467 | A1 * | 10/2017 | Solotoff | A61J 1/1437 |
| 2019/0309849 | A1 * | 10/2019 | Petzke | F16J 15/0818 |
| 2022/0111129 | A1 * | 4/2022 | Stewart | A61H 9/0057 |

* cited by examiner

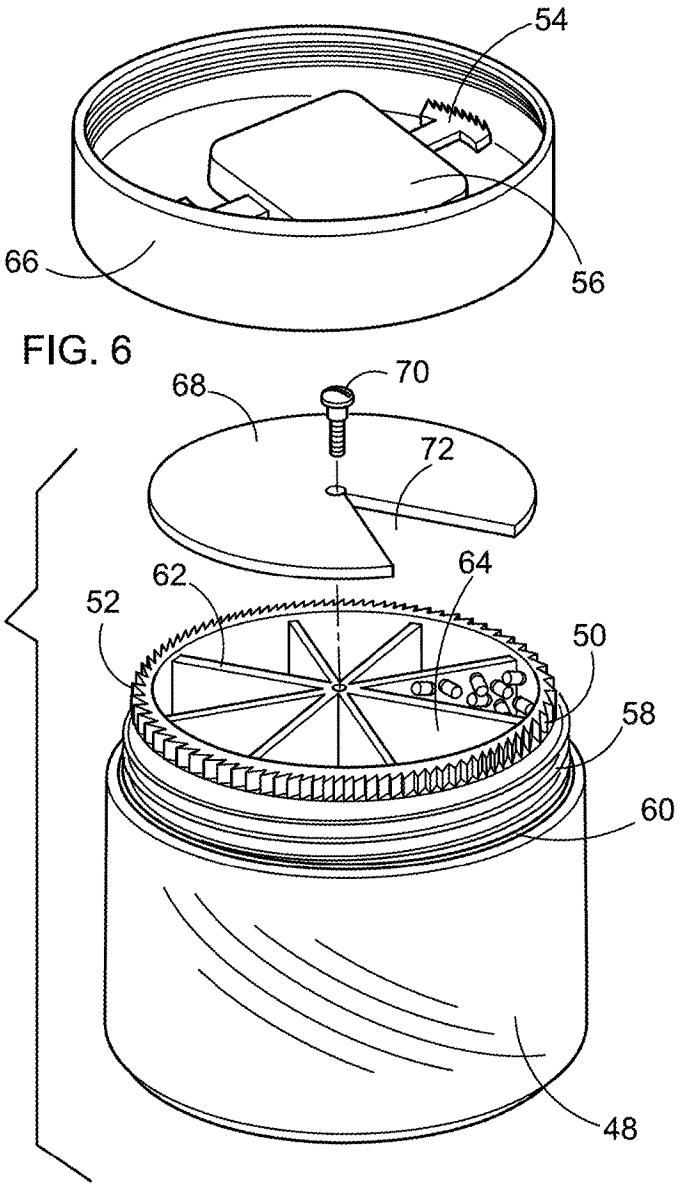
FIG. 6
FIG. 5
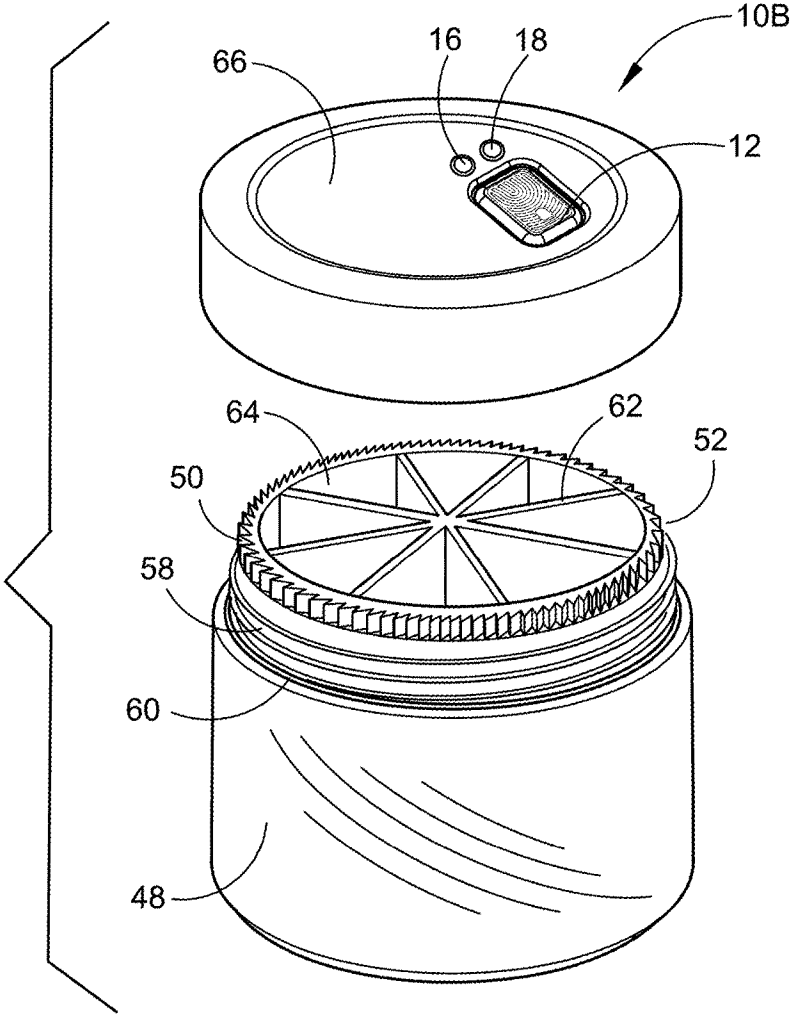
FIG. 4

WIRELESS CONTROLLED LOCKING JAR WITH INTEGRATED VACUUM PUMP

CROSS-REFERENCE TO RELATED APPLICATIONS

The present non-provisional patent application is a continuation-in-part of Applicant's patent application Ser. No. 16/540,136 filed on Aug. 14, 2019, now U.S. Pat. No. 11,352,179, which said application is a continuation-in-part of Ser. No. 15/893,617 filed on Feb. 10, 2018, now abandoned.

FIELD OF THE INVENTION

This application is directed to a Wireless Controlled Locking Jar with Integrated Vacuum Pump. More particularly, this application provides a wireless controlled lock on a jar lid having a built-in electrically powered vacuum pump and lid gasket which acts to lock the jar from unauthorized access by pulling a vacuum within the jar. The locking jar may be used to keep contents secure and fresh, and also out of the reach of children or other unauthorized individuals as it employs the user's Wi-Fi connected or Bluetooth paired smartphone or other device, in combination with a smartphone or other device application, to lock and open the jar and allow access to the contents inside.

BACKGROUND OF THE INVENTION

There is growing need to provide an adequate safe means to store substances in an airtight and safe environment, such as Cannabis and Opioids, or pills that may be harmful to adults or children if left in open containers with free access. The Wireless Controlled Locking Jar with Integrated Vacuum Pump system offers a new and unique fingerprint or thumb print enrollment/reader for opening the devices without the use of cumbersome keys that can be easily misplaced or lost. Cannabis, Opioids and other drugs may be useful and legal to possess but can also be deadly for children and adults that are not responsible for their actions and should be handled with great caution. The Wireless Controlled Locking Jar with Integrated Vacuum Pump of the present invention seals and locks through the use of a vacuum, that is, when a vacuum is pulled on the jar, the lid will not come off.

In some circumstances, the tobacco-like articles may be stored in clear glass containers in a manner that permits excessive moisture migration into or out of the material. For example, moist Cannabis should not be stored in a manner that permits significant migration of moisture in and out of the container during both the product shelf life and the period of consumer use. Such moisture egress from the containers can cause the moist Cannabis to lose moisture and suffer a loss of freshness characteristics as well as negatively impact on desirable qualities of other tobacco like products.

Numerous innovations for containers have been provided in the prior art described as follows. Even though these innovations may be suitable for the specific individual purposes to which they address, they differ from the present Wireless Controlled Locking Jar with Integrated Vacuum Pump as hereinafter contrasted. The following is a summary of those prior art patents most relevant to the Wireless Controlled Locking Jar with Integrated Vacuum Pump at hand, as well as a description outlining the difference between the features of the present application and those of the prior art.

U.S. Pat. No. 8,556,070 of David Karl Bried et al. describes a tobacco product package device that can be used to enhance freshness and other characteristics of tobacco products or other products contained therein. Certain features can improve product freshness both during shelf life and during consumer use.

This patent describes a tobacco product package device that can be used to enhance freshness and other characteristics of tobacco products or other products contained therein but does not describe the unique biometric locking system using the finger or thumb unlocking means or anything similar to the Wireless Controlled Locking Jar with Integrated Vacuum Pump that will be made from a smoke tinted glass or a high-grade smoke tinted polymer, as well as from metals, alloys and composite materials.

U.S. Pat. No. 9,572,748 of Kevin Lim et al. describes a container that includes a chamber to hold a medication, a lockable lid that covers an opening of the chamber, a biometric sensor, a scale, and one or more processors. The container may store prescription information indicating how often the medication should be provided. The container may measure a weight of the medication held by the chamber using the scale. The container may receive biometric information sensed by the biometric sensor. The biometric information may indicate a biometric feature of a person attempting to open the container. The container may selectively unlock the lockable lid based on at least one of the prescription information, the weight of the medication, or the biometric information.

This patent describes a product package device for holding medications with a lockable lid that covers an opening of the chamber, a biometric sensor, a scale, and one or more processors. This patent deals with an involved service piece of equipment that requires a computer network to effectively work and does not describe a container for dispensing or hold pills or Cannibals or have the biometric fingerprint or thumb print locking means.

U.S. Pat. No. 9,630,747 of William Thomas Smith et al. describes a container for displaying, visualizing, and aroma sampling botanical materials—such as tea, cannabis, and the like including a container body, lid, and lens. The container body is shaped to define a mounting projection wherein a sample, such as a botanical sample, may be held. Container body and lid form an airtight seal. A sample may be visualized through the lens. In a preferred embodiment, lid is shaped to define scent openings permitting aroma sampling of a sample contained within. In one embodiment option, one or more projections secure a card bearing sample identification information.

This patent describes a container for displaying, visualizing, and aroma sampling botanical materials. This container would not offer the airtight seal and the biometric finger or thumb locking means on a compact or jar style of container.

US Patent Application Publication No. 2017/0190482 of William Thomas Smith et al. describes embodiment containers for displaying, visualizing, and aroma sampling botanical materials—such as tea, cannabis, and the like including a container body, lid, and lens—which may have various shapes. In a preferred embodiment, lid is shaped to define a recessed area with scent openings permitting aroma sampling of a sample contained within. A removable plug is shaped to fit within the recessed area of the lid. The container body and lid, with removable plug fit within the lid, form an airtight chamber within. A botanical sample may be visualized through the lens.

This patent describes a second container for displaying, visualizing, and aroma sampling of botanical materials such as tea and cannabis where a botanical sample may be visualized through the lens by readjusting the holding components of the device.

U.S. Pat. No. 9,869,978 of Mathew R. Gibertson et al. describes a method for commissioning a collection of electronic locks by inserting the same electronic key into each of the locks and recording in the electronic key an internal code unique to that lock which identifies the lock and is needed to open the lock and a method for biometrically permitting controlled secure access to a container having one of the commissioned electronic locks.

This patent describes a method for biometrically permitting controlled secure access to a container having one of the commissioned electronic locks. It does not describe the use of the biometric locking system using the fingerprint or thumb print actuated unlocking means to unlock small or large containers holding cannabis or pills.

U.S. Pat. No. 9,355,510 of Rick Crigger et al. describes a biometric access control system includes an equipment structure in communication with an identification station, which includes a processor, a user biometric reader, an equipment identification reader, a user interface to display categories of equipment authorized for use by a user and to receive input from the user including an indication to acquire or return the piece of equipment and a selection of an equipment category and a selection of a specific piece of equipment of the selected equipment category. The equipment structure includes storage locations for storing pieces of equipment assigned to the storage locations, and locks corresponding to the storage locations for individually securing the pieces of equipment to the structure, wherein an authorization signal from the identification station is receivable to release a lock containing the selected specific piece of equipment to permit removal of the selected specific piece of equipment.

This patent describes a sophisticated weapon storage system using biometric components but does not use the biometric locking system using the fingerprint or thumb print actuation unlocking means to unlock a pill or cannabis container.

US Patent Application Publication No. 2017/0046898 of Steven D. Cabouli describes a Biometric and Bluetooth enabled vehicle Console and Glove Box Lock that provides a unique apparatus for locking enclosures such as any locking compartment within a vehicle as well as the vehicle doors, vehicle hood and vehicle trunk locks, and the like, with indirect operational control by the means of a smartphone, tablet or a computer. The Biometric and Bluetooth enabled vehicle Console and Glove Box Lock contains a biometric based fingerprint authentication module, and a Bluetooth/RF COMM communication enabled module, to prevent a non-owner or unauthorized user from accessing the device.

This patent describes a Biometric and Bluetooth enabled vehicle Console and Glove Box Lock that provides a unique apparatus for locking enclosures such as any locking compartment within a vehicle but does not involve the process of biometric locking containers used for Cannabis and Pills. It does not offer the unique feature of the ratchet configuration on a container engaging with the mating ratchet members on the biometric locking mechanism of the jar.

US Patent Application Publication No. 2016/0360351 of Steven D. Cabouli describes a Biometric and Bluetooth Enabled Case Lock System and method that provides a unique apparatus for locking enclosures such as luggage, briefcases, lockers, lock boxes and cabinets, and the like, with indirect operational control by the means of a smart phone, tablet or a computer. The Biometric and Bluetooth Enabled Case Lock system contains a biometric based fingerprint authentication module, and a Bluetooth communication enabled module, to prevent a non-owner or unauthorized user from accessing the device. An on-board system processor controls and interprets commands passed from the user's external Bluetooth device, whereby said case lock system is controllable via an application on a smartphone, tablet or a computer.

This patent describes a Biometric and Bluetooth Enabled Case Lock System that provides a unique apparatus for locking enclosures such as luggage, briefcases, lockers, lock boxes and cabinets but does not offer a safe, airtight containers using a unique style of biometric locking mechanism in the storage of Pills or Cannabis.

None of the foregoing prior art teaches or suggests the particular unique features of the Wireless Controlled Locking Jar with Integrated Vacuum Pump and thus clarifies the need for further improvements in the devices that can be used for these purposes.

In this respect, before explaining at least one embodiment of the Wireless Controlled Locking Jar with Integrated Vacuum Pump in detail it is to be understood that the design is not limited in its application to the details of construction and to the arrangement of the components set forth in the following description or illustrated in the drawings. The Wireless Controlled Locking Jar with Integrated Vacuum Pump are capable of other embodiments and of being practiced and carried out in various ways. Also, it is to be understood that the phraseology and terminology employed herein are for the purpose of description and should not be regarded as limiting.

SUMMARY OF THE INVENTION

The primary advantage of the Wireless Controlled Locking Jar with Integrated Vacuum Pump is to provide an adequate safe and secure means to store substances in an airtight environment, such as Cannabis, edibles or pills that may be harmful to adults or children if left in open unsecured containers.

Another advantage of the Wireless Controlled Locking Cannabis/Pill Containers is that they are locked by the means of unique wireless controlled locking device operated only by the fingerprint or thumb print activation means.

Another advantage of the Wireless Controlled Locking Jar with Integrated Vacuum Pump is the battery indicator lights displaying green for sensor activation and red for low battery power along with the fact that the units will remain open when the battery has run out of power.

Another advantage of the Wireless Controlled Locking Jar with Integrated Vacuum Pump is that by holding the products in a sealed airtight environment it will extend their useable life span.

The advantage of the preferred embodiment of the Wireless Controlled Locking Jar with Integrated Vacuum Pump is its scalability from small size prescription bottles up to large size 50 gallon drums, and airtight sealing capability throughout the entire size range.

Another advantage of the preferred embodiment of the Wireless Controlled Locking Jar with Integrated Vacuum Pump is that they will optionally have several different interchangeable product organization and containment means.

The advantage of the alternate embodiment of the Wireless Controlled Locking Jar with Integrated Vacuum Pump is that it is scalable to a size that can hold larger quantities of substances within an airtight sealing and locked environment.

Another advantage of the alternate embodiment of the Wireless Controlled Locking Jar with Integrated Vacuum Pump is it can have several optional different internal styles of holding cavities.

Another advantage of the alternate embodiment of the Wireless Controlled Locking Jar with Integrated Vacuum Pump is it can come with a rotatable disk on a shoulder screw with an opening to separately isolate each of the holding cavities.

Another advantage of the alternate embodiment of the Wireless Controlled Locking Jar with Integrated Vacuum Pump is it will have a threaded lid that will rotate down to tighten against an O-ring sealing means.

Another advantage of the alternate embodiment of the Wireless Controlled Locking Jar with Integrated Vacuum Pump is it will only need a ninety degree to one hundred and eighty degree turn to tighten the lid against the O-ring seal.

Another advantage of the alternate embodiment of the Wireless Controlled Locking Jar with Integrated Vacuum Pump is it will have the biometric locking mechanism on the underside of the lid with two ratchet or gear style engaging arms that have the capability of securely locating at any two locations on the ratchet or gear configuration above the threads on the upper edge surface of the jar.

Another advantage of the alternate embodiment of the Wireless Controlled Locking Jar with Integrated Vacuum Pump is it will make the ratcheting sound when rotating the lid down and the ratchet locking member will be retracted by the means of the unique Wireless Controlled Locking device operated only by a fingerprint or thumb print activation means.

Another advantage of the alternate embodiment of the Wireless Controlled Locking Jar with Integrated Vacuum Pump is the jar will preferably be made from a smoke tinted tempered glass but could be made from a high-grade smoke tinted polymer, thermoplastic, stainless steel or a composite material and still remain within the scope of this application.

Another advantage of the alternate embodiment of the Wireless Controlled Locking Jar with Integrated Vacuum Pump is that it can be manufactured in a variety of different sizes from small personal sizes up to very large sizes to be used in stores that sell products like controlled substances, pharmaceuticals, Cannabis, edibles or pills which require a secure easy opening and sealing means of storage where a sales person only needs to put their thumb print or fingerprint on the biometric lock to unlock lid and turn the lid ninety degrees to one hundred and eighty degrees to open the jar and then replace and relock the lid after the sale is completed.

These together with other advantages of the Wireless Controlled Locking Jar with Integrated Vacuum Pump, along with the various features of novelty, which characterize the design are pointed out with particularity in the claims annexed to and forming a part of this disclosure. For a better understanding of the Wireless Controlled Locking Jar with Integrated Vacuum Pump, their operating advantages and the specific objects attained by its uses, reference should be made to the accompanying drawings and descriptive matter in which there are illustrated preferred embodiments of the Wireless Controlled Locking Jar with integrated Vacuum Pump. There has thus been outlined, rather broadly, the more important features of the design in order that the detailed description thereof that follows may be better understood, and in order that the present contribution to the art may be better appreciated. There are additional features of the Wireless Controlled Locking Jar with Integrated Vacuum Pump that will be described hereinafter, and which will form the subject matter of the claims appended hereto.

The preferred embodiment of the Wireless Controlled Locking Jar with Integrated Vacuum Pump with a built-in electric pump has an electrically powered pump that is activated to turn on and pull a vacuum, or release the vacuum inside the container jar through a wireless connection with a smartphone or other wireless device using Wi-Fi and or Bluetooth connectivity. After a few seconds the electric pump will have extracted all air inside the jar/bottle and the lid cannot be removed because of the vacuum created, making it virtually impossible to remove it. The jar/bottle can then be opened once the user's paired device, smartphone or tablet and the like, using a software application powers on the electric pump which after a few seconds of operating independently will insert enough air inside the jar to release the vacuum and break the seal and allow a user to readily remove the lid from the jar/bottle.

The Wireless Controlled Locking Jar with Integrated Vacuum Pump will consist of a container having an upper lid portion and a lower jar portion. The upper lid portion has a push button with light emitting diode (LED) on the upper surface of lid portion, used for pairing a device such as a smartphone, tablet or the like. The upper lid portion also has a universal serial bus (USB) port used to charge the battery located within the upper lid portion. Within the upper lid portion which acts as a components housing numerous inner working components including a push button spring located below the push button. The push button spring is connected to a printed circuit board. A battery power source is located below the printed circuit board and in electrical communication with the printed circuit board. Also housed within the upper lid portion is a battery powered vacuum pump mounted to a frame which is connected to vacuum hoses and a filter. The filter acts to filter out debris when pulling a vacuum from the lower jar portion, to keep the debris from entering and contaminating the vacuum pump. The lower jar portion has a male threaded top section which mates with corresponding female threads on the upper lid portion bottom section. The upper lid portion includes a silicone seal gasket which forms an airtight seal when the lid portion and lower jar portion are threaded tightly together.

In embodiments, the Wireless Controlled Locking Jar with Integrated Vacuum Pump will include an upper lid portion having an outer housing surface directly below the silicone sealing gasket having a plurality of carved out vent channels radiating outward from the central circular vent channel located on the bottom of the outer housing surface of the lid portion. At the distal end of each of the radiating vent channels are orifices. These orifices are in communication with the vacuum pump hoses and the vacuum pump pulls air from the lower jar portion through these orifices and radiating vent channels. The vent orifices located through the silicone seal gasket are located directly above the circular vent channel. This configuration of orifices vents and vent channels allows air to be removed (locked) or released back into the lower jar portion (unlocked) by operation of the vacuum pump. In operation, when the vacuum pump is activated, air is forced out of the lower jar portion through the vent orifices in the silicone seal gasket, through the circular vent channel carved out in the inner surface of the upper lid portion, through the radiating vent channels, and to the vent orifices on the distal ends of the radiating vent channels, then into the vacuum pump hoses, and is expelled.

Further included in embodiments, the Wireless Control led Locking Jar with Integrated Vacuum Pump will include a software APP which allows pairing to a wireless device via Wi-Fi and or Bluetooth connectivity and after a user logs in allows a user to lock and unlock the container by employing a lock button and an unlock button. Once connection status is established, the lock button can be pushed to activate the vacuum pump located within the paired Wireless Controlled Locking Jar with Integrated Vacuum Pump to pull a vacuum within the lower jar portion of the container. While the vacuum pump is in operation pulling a vacuum, the LED will be flashing. Once a vacuum is pulled and established within the lower jar portion, it will be impossible to open the container and access the contents within the container. Alternatively, the unlock button may be pushed to release an existing vacuum from the lower jar portion, in that pushing the unlock button releases the air back into the lower jar portion and breaks the vacuum seal allowing a user to readily open the container by unthreading the upper lid portion from the lower jar portion to access the contents stored within the container. The Wireless Controlled Locking Jar with Integrated Vacuum Pump can be manufactured in a variety of different sizes from small personal sizes up to very large sizes to be used in stores that sell products that need to be kept in a locked controlled environment.

With respect to the above description then, it is to be realized that the optimum dimensional relationships for the parts of the Biometric Locking Jar with Integrated Vacuum Pump, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the Biometric Locking Jar with Integrated Vacuum Pump. Further, since numerous modifications and changes will readily occur to those skilled in the art, it is not desired to limit the Biometric Locking Jar with Integrated Vacuum Pump to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Biometric Locking Cannabis/Pill Containers and together with the description, serve to explain the principles of this application.

FIG. 4 depicts the alternate embodiment of the Biometric Locking Cannabis/Pill Container with organizational inserts dividing the central area into different organization cavities and the lid exploded away.

FIG. 5 depicts the alternate embodiment of the Biometric Locking Cannabis/Pill Container with organizational inserts dividing the central area into different organization cavities with a rotatable disk, a shoulder screw and an opening to separately isolate each of the holding cavities.

FIG. 6 depicts the lid exposing the underside of the Biometric Locking Cannabis/Pill Container.

DETAILED DESCRIPTION OF THE PREFERRED EMBODIMENTS

As required, the detailed embodiments of the present Biometric Locking Cannabis/Pill Containers 10A, 10B, 10C, 10D 10E, 10F, 10G and the Wireless Controlled Locking Jar with Integrated Vacuum Pump 10H are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure.

Figures 1, 2, 3:
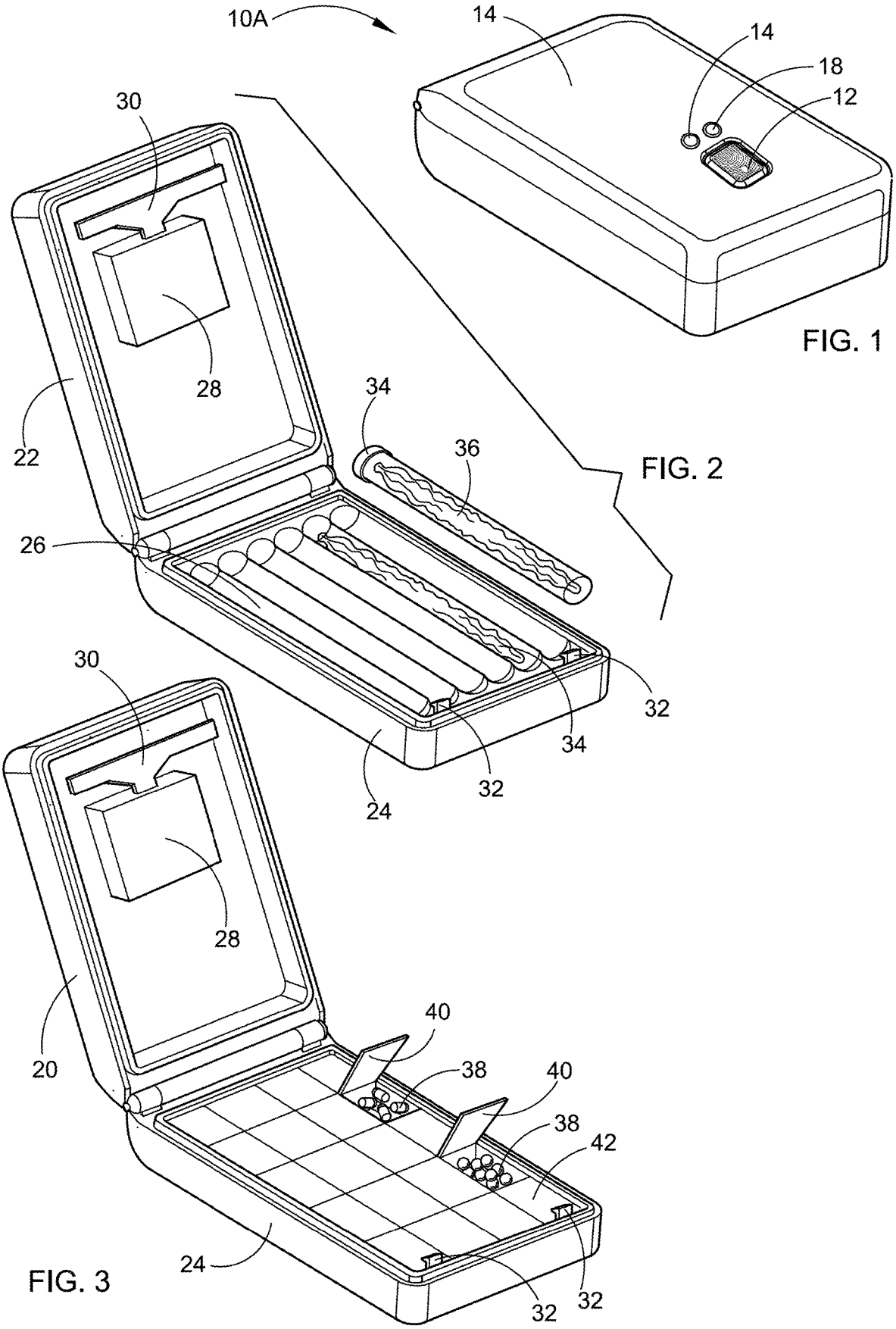
FIG. 1 depicts a Compact Biometric Locking Cannabis/Pill Container in the closed position with the biometric finger or thumb print activation opening mechanism on the top surface.
FIG. 2 depicts a Compact Biometric Locking Cannabis/Pill Container in the open position with the tubular storage means and the Biometric Locking mechanism exposed.
FIG. 3 depicts a Compact Biometric Locking Cannabis/Pill Container in the open position with a pill organization and storage area in the bottom portion.

FIG. 1 depicts a Compact Biometric Locking Cannabis/Pill Container 10A in the closed position with the biometric finger or thumb print activation opening mechanism 12 on the container top surface 14. Adjacent to the activation mechanism 12 is a red LED light 16 indicating low battery power and a green LED light 18 displaying opening activation. A rubber seal 20 runs around the perimeter of both the container top 22 and the container bottom 24 to create the airtight seal. This compact configuration resembles a wallet and can be easily carried in a user's pocket keeping the contents safe from unauthorized access. These containers can vary in size from the convenient pocket size to larger display sizes and still remain within the scope of this application.

FIG. 2 depicts a Compact Biometric Locking Cannabis/Pill Container 10A with the container top 22 in the open position exposing the tubular storage means 26 and the Biometric Locking mechanism 28. The locking bar 30 on the Biometric Locking mechanism 28 will automatically engage within the locking tabs 32 on the front edge of the container bottom 24 when the device is closed. A sealed tubular container 34 containing Cannabis 36 is exploded away.

FIG. 3 depicts a Compact Biometric Locking Cannabis/Pill Container 10A in the open position with the Biometric Locking mechanism 28 in the container top 22 and the pill storage area 38 with compartment lids 40 on each compartment 42 in the container bottom 24.

FIG. 4 depicts the alternate embodiment of the Biometric Locking Cannabis/Pill Container 10B consisting of a smoked glass or possibly high-grade smoke polymer container 48. The Biometric Locking Cannabis/Pill Container 10B will have a ratchet or gear style of locking surface 50 on the upper edge surface 52 which will engage with a mating surface on the locking arms 54 of the biometric locking mechanism 56 located on the underside of the lid. Threads 58 and an O-ring 60 will be below the ratchet or gear style of locking surface 50. An insert 62 can be used to divide the central area into different cavities 64. The Jar lid 66 will have the finger or thumb unlocking means 12 with the red LED light 16 indicating low battery power and a green LED light 18 displaying sensor activation.

FIG. 5 depicts the alternate embodiment of the Biometric Locking Cannabis/Pill Container 10B with inserts 62 dividing the central area into different cavities 64 with rotatable disk 68 on a shoulder screw 70 with an opening 72 to separately isolate each of the holding cavities 64.

FIG. 6 depicts the underside of the Biometric Locking Cannabis/Pill Container Jar 10B lid 66, illustrating the location of one of the Biometric Locking arms of 54.

Figure 7:
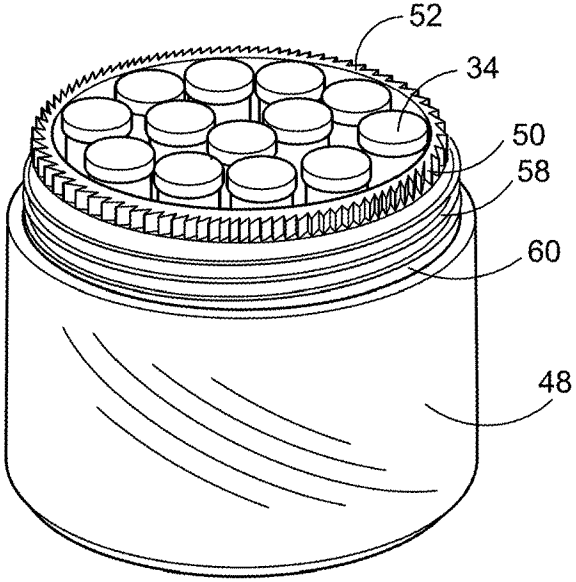
FIG. 7 depicts an open Biometric Locking Cannabis/Pill Container exposing sealed tubular cylinders.

FIG. 7 depicts an open Biometric Locking Cannabis/Pill Container 10B exposing sealed tubular cylinders 34 with a portion of Cannabis 36 exploded away.

Figure 8:
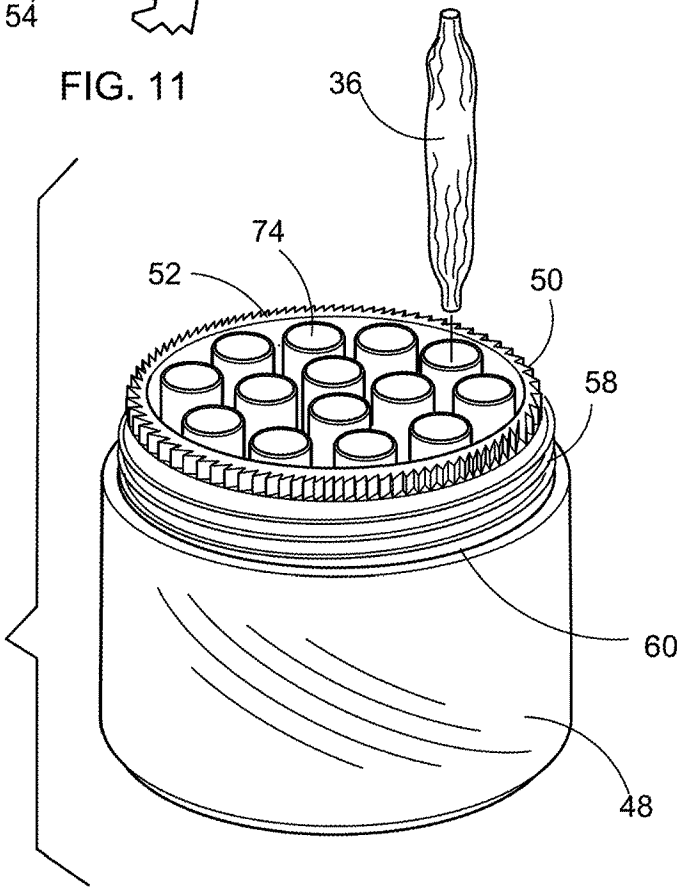
FIG. 8 depicts an open Biometric Locking Cannabis/Pill Container with open tubular cylinders.

FIG. 8 depicts an open Biometric Locking Cannabis/Pill Container 10B with open tubular cylinders 74.

Figure 9:
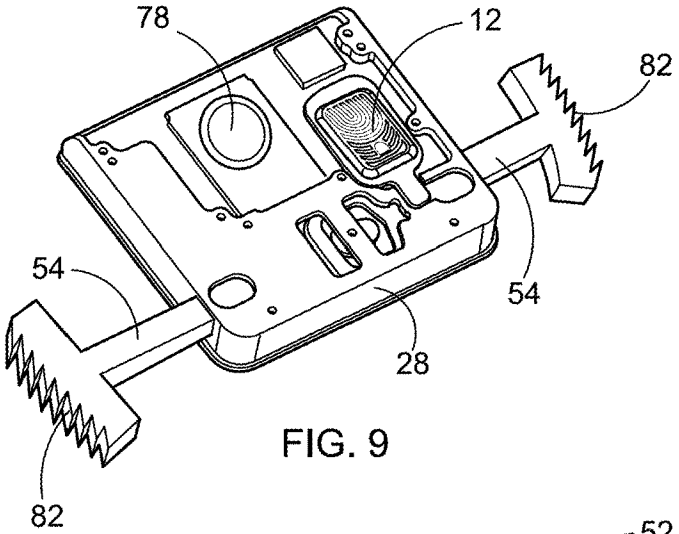
FIG. 9 depicts the underside of the biometric locking mechanism.

FIG. 9 depicts the underside of the Biometric Locking mechanism 28 illustrating the finger and thumb activation sensor 12, the battery 78 and the locking arms 54. At the end of each of the locking arms 54 are the locking heads 82 that will engage in the unique style of locking upper edge surface 52 of the smoked glass or high-grade smoke polymer container 48.

Figure 10:
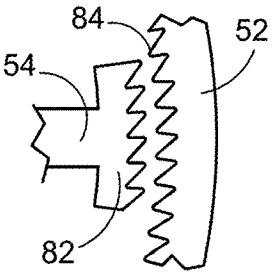
FIG. 10 depicts the ratchet style of the locking mechanism.

FIG. 10 depicts the ratchet style of locking mechanism with a ratchet configuration 84 on the locking head 82 of the Biometric Locking mechanism 28 and a mating style of the ratchet configuration 84 on the Jar upper edge surface 52.

Figure 11:
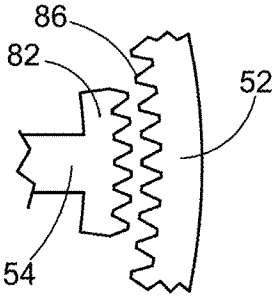
FIG. 11 depicts the gear style of the locking mechanism.

FIG. 11 depicts the gear style of locking mechanism with a common gear configuration 84 on the locking heads of the Biometric Locking mechanism 28 and a mating style of the common gear configuration 86 on the Jar upper edge surface 52.

Figure 12:
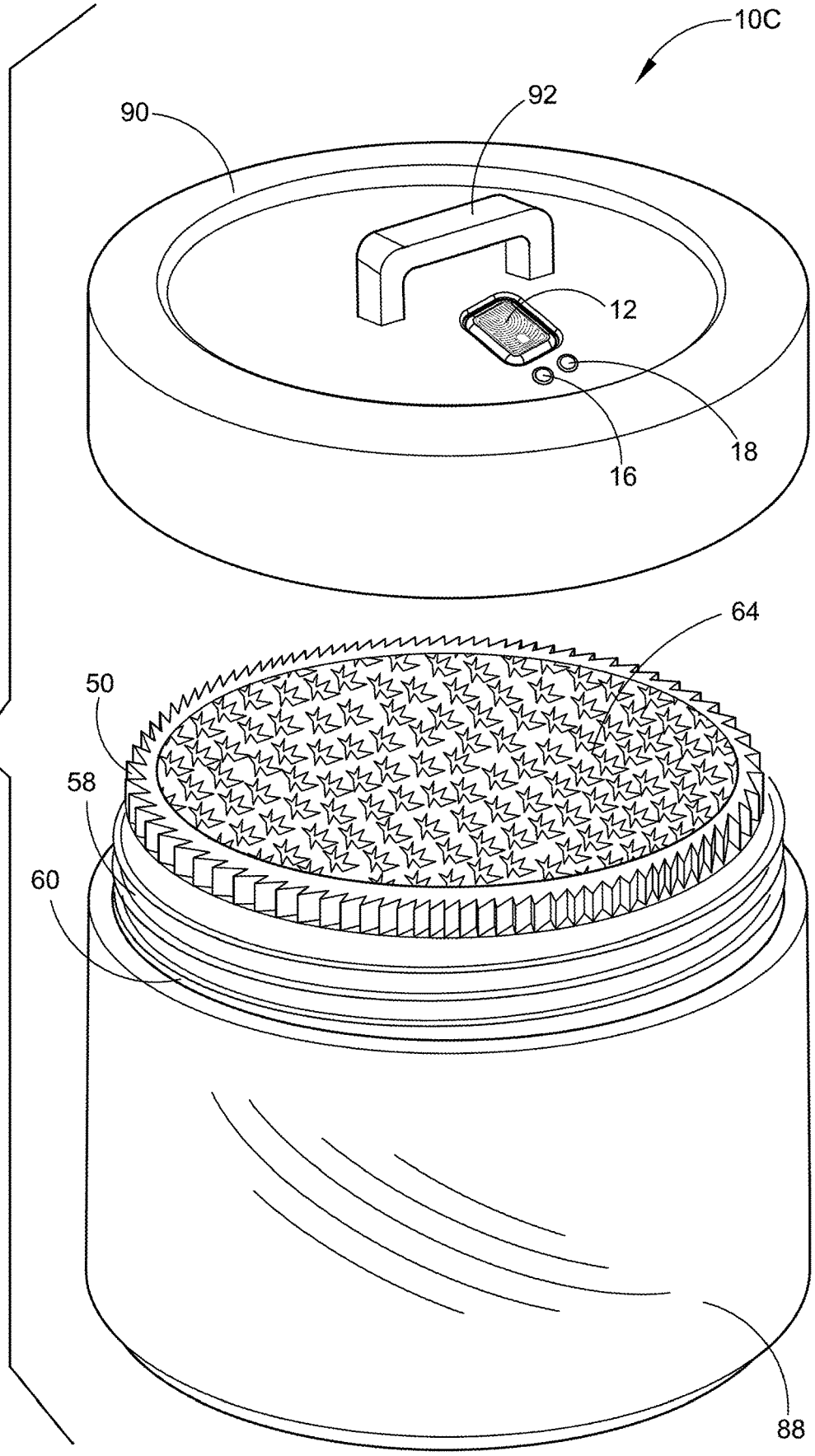
FIG. 12 depicts a large Biometric Locking Cannabis/Pill Container having a screw on lid with the handle and finger or thumb activation means.

FIG. 12 depicts a large Biometric Locking Cannabis/Pill Container 10C consisting of a smoked glass or possibly high-grade smoke polymer 88 having the screw on lid 90 with the handle 92 and finger or thumb activation means 12 filled with Cannabis 64. The large Jar lid 66 will have the activation finger or thumb locking means 12 with the red LED light 16 indicating low battery power and a green LED light 18 displaying sensor activation. It is anticipated that many sizes of jars may be employed, including small, medium size and large to very large containers, all equipped with a biometric locking mechanism within the lid assembly.

Figure 13:
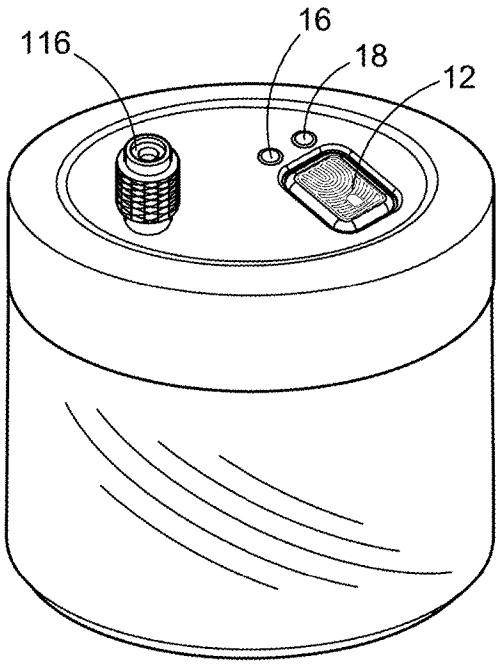
FIG. 13 depicts a large Biometric Locking Cannabis/Pill Container having a screw on lid with the handle and finger or thumb activation means, illustrating a vacuum pump connection fitting mounted on the top of the lid.
Figure 14:
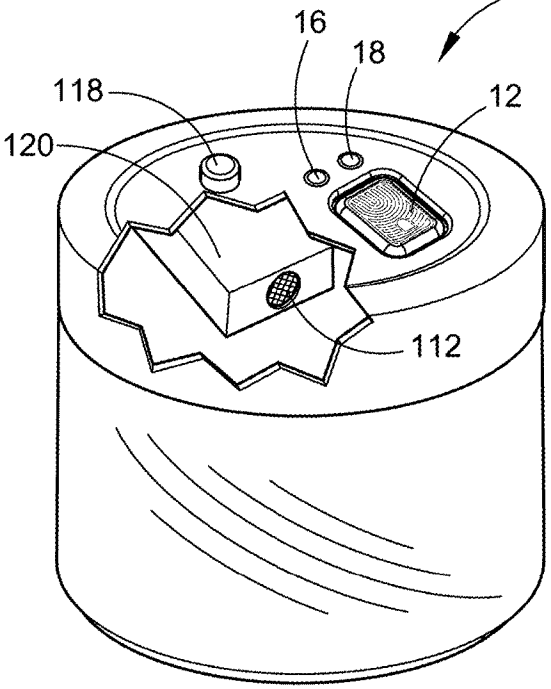
FIG. 14 depicts a large Biometric Locking Cannabis/Pill Container having a screw on lid with the handle and finger or thumb activation means, illustrating an electrically operated vacuum pump mounted within the lid.

FIG. 13 depicts a large Biometric Locking Cannabis/Pill Container having a screw on lid 10D with the finger or thumb print activation means, illustrating a vacuum pump connection fitting 116 mounted on the top of the lid. To create a vacuum inside the Biometric Locking Cannabis/Pill Container 10D the vacuum pump connection fitting 116 would be connected to a hose running from a vacuum pump, then the pump turned on and vacuum inside the container would result. In this way, numerous containers could be connected in series and a vacuum created in each, or they could be connected on at a time to create a vacuum within the several containers FIG. 14 depicts a large Jar Biometric Locking Cannabis/Pill Container having a screw on lid 10E with the finger or thumb biometric activation means, illustrating an electrically operated vacuum pump 120 mounted within the lid. This electrically operated vacuum pump 120 would be turned on and off using the on/off button switch 118. When the electrically operated vacuum pump 120 is turned on it would pull a vacuum from the container through screen 112 which would keep particles from entering the electrically operated vacuum pump 120. This electrically operated pump could be powered by the biometric locking mechanism battery or have its own on-board battery for a power source. It is anticipated that lithium-ion batteries would be employed.

Figure 15:
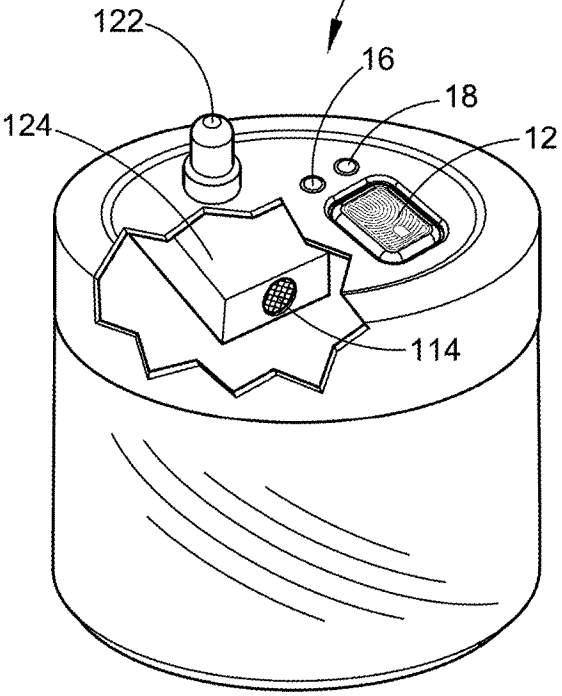
FIG. 15 depicts a large Biometric Locking Cannabis/Pill Container having a screw on lid with the handle and finger or thumb activation means, illustrating a manually operated vacuum pump mounted within the lid.

FIG. 15 depicts a large Jar Biometric Locking Cannabis/Pill Container having a screw on lid 10F with the biometric finger or thumb print activation means, illustrating a manually operated vacuum pump 124 mounted within the lid. The manually operated vacuum pump 124 is operated by pumping up and down on the pump button 122. This pumping action creates a vacuum within the container. As the pumping action of button 122 continued, a vacuum would be pulled within the container through screen 114 which would keep particles from entering the electrically operated vacuum pump 124.

Figure 16:
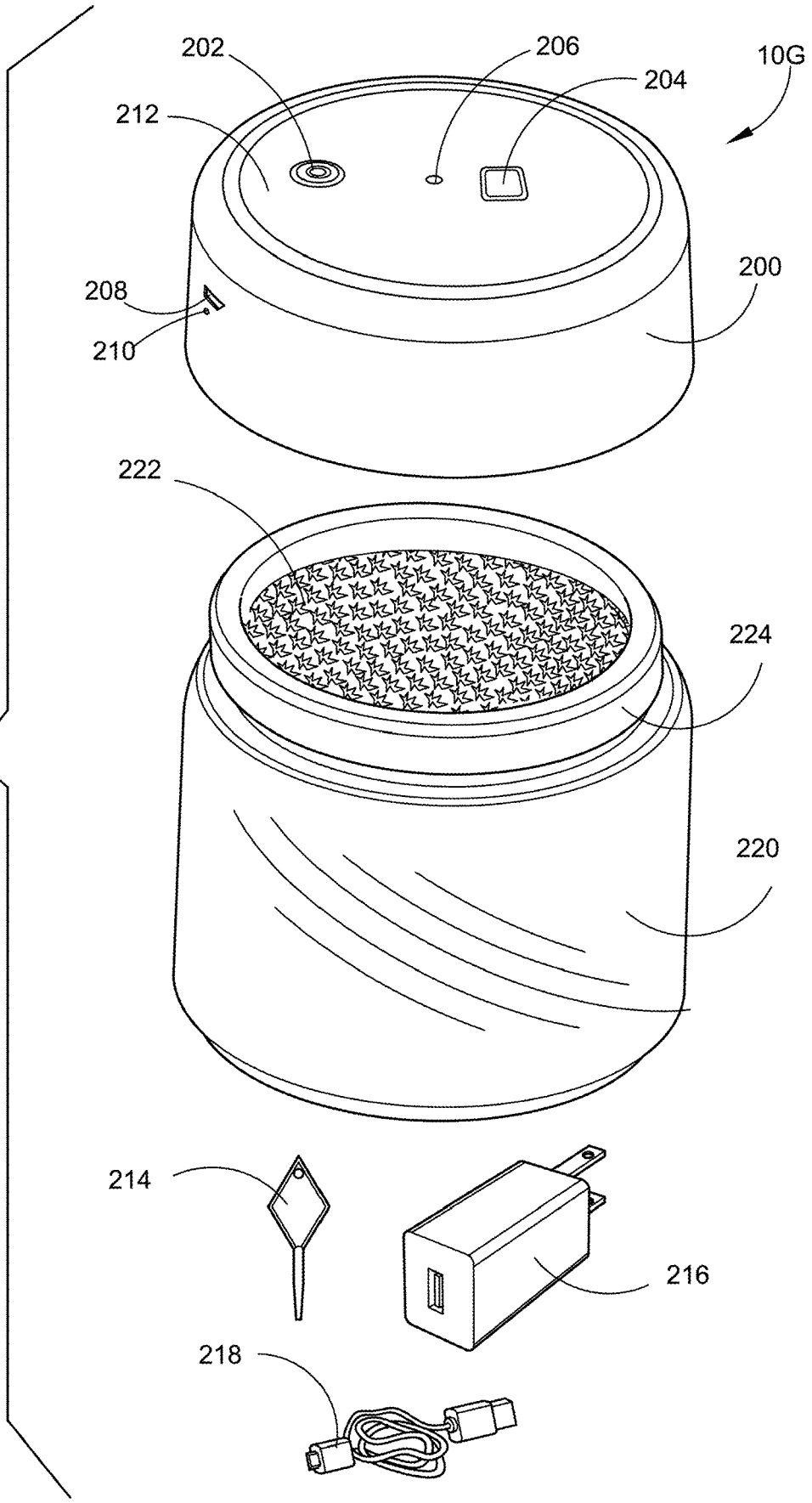
FIG. 16 depicts a full product kit for the Biometric Locking Jar with Integrated Vacuum Pump including the lid, the jar, a fingerprint enrollment key, a USB charger and a charging cord.

FIG. 16 depicts a full product kit for the Biometric Locking Jar with Integrated Vacuum Pump 10G including the locking lid 200, the jar 220, a fingerprint enrollment key 214, a USB charger 216 and a charging cord 218. Located on the top surface 212 of the locking lid 200 are an ON/OFF button 202, a fingerprint enrollment/reader 204, and an indicator LED light 206. Located on the side of the locking lid 200 are a USB charging cord port 208 and an air vent 210. The jar 220 shows contents 222 within the container and a smooth locking lid interface rim 224 described in greater detail below. In operation, when the ON/OFF button 202 is pushed, the vacuum pump is activated and pulls a vacuum within the jar, thereby sealing and securing the lid thereon. To release the sealed inner vacuum within the jar, a user must use an authorized enrolled fingerprint, swipe the finger across the fingerprint enrollment/reader 204 and this will release the vacuum through the air vent 210. The jar 220 may be made out of glass, thermoplastic, stainless steel or a composite material.

Figure 17:
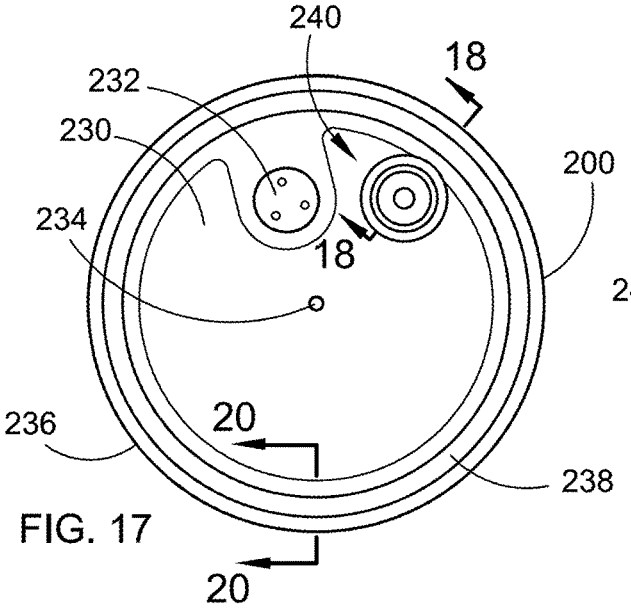
FIG. 17 depicts a bottom view of the biometric locking lid.

FIG. 17 depicts a bottom view of the biometric locking lid 200. Features of the lower surface 230 of the lid include an air vent assembly 232, a fingerprint enrolling/reset button 234, and vacuum intake/check valve/filter element assembly 240 described in greater detail below. Along the circumference of the outer shell 236 of the biometric locking lid is a jar rim accepting and sealing groove 238. In operation, when pulling a vacuum, air is drawn from the jar through the vacuum intake/check valve/filter element assembly 240. The filter element 242 is positioned to ensure that dust and particles are not sent into the vacuum pump (not shown here, but described in greater detail below). In operation, the fingerprint enrollment key 214 (see FIG. 16) is inserted into the fingerprint enrolling/reset button 234 to enroll a user's fingerprint and to reset the CPU microprocessor and fingerprint enrolling feature within the biometric locking lid 200.

Figure 18:
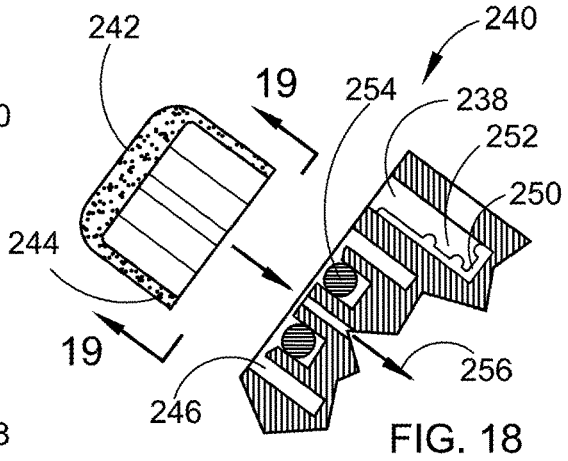
FIG. 18 depicts a cross sectional view of the vacuum valve/check valve/filter element assembly.

FIG. 18 depicts a cross sectional view of the vacuum intake/check valve/filter element assembly 240. The filter element 242 has sides which fit into grooves 246 and is sealed by O-ring 254. Air from the inside of the jar is drawn through the port centrally located in the vacuum intake/check valve/filter element assembly 240 in the direction of arrow 256.

Figure 19:
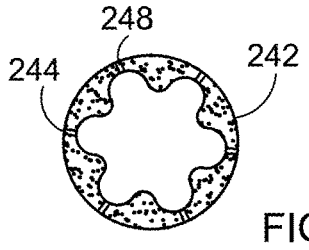
FIG. 19 depicts a bottom view of the filter element illustrating the flower lobe configuration of the filter.

FIG. 19 depicts a bottom view of the filter element 242 illustrating the flower lobe 248 configuration of the filter element cup sides 244.

Figure 20:
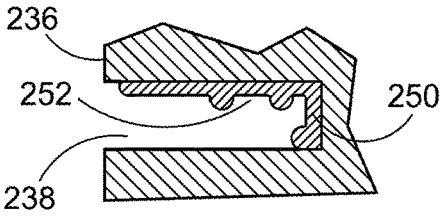
FIG. 20 depicts a cross sectional view of the labyrinth seal jar interfacing gasket running around the perimeter of the outer portion of the lid.

FIG. 20 depicts a cross sectional view of the labyrinth seal lid/jar interfacing gasket 250 running around the perimeter groove 238 of the outer portion 236 of the biometric locking lid 200. The labyrinth seal lid/jar interfacing gasket 250 includes a double bump side portion 252 of the gasket 250 to ensure a better seal, and to hold the vacuum generated within the jar. A microprocessor housed within the lid 200 (see FIG. 23) may be programmed to automatically activate the battery operated vacuum pump also housed within the lid 200 to pull a vacuum every three to seven days or so, to ensure that the generated vacuum within the jar 220 is not lost and the lid 200 remains securely attached to the jar 220.

Figure 21:
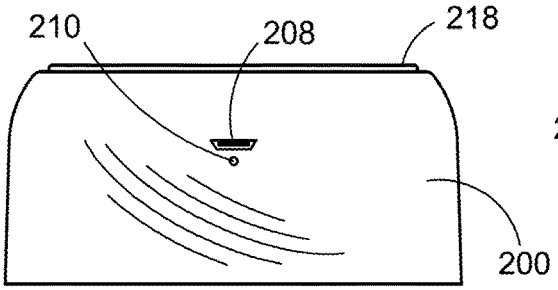
FIG. 21 depicts a side view of the lacking lid, illustrating the position of the USB charging port and the air vent orifice.

FIG. 21 depicts a side view of the biometric locking lid 200, showing the upper surface of the biometric locking lid 218, and illustrating the position of the USB charging port 208 and the air vent orifice 210 located on the sides of the biometric locking lid 200.

Figure 22:
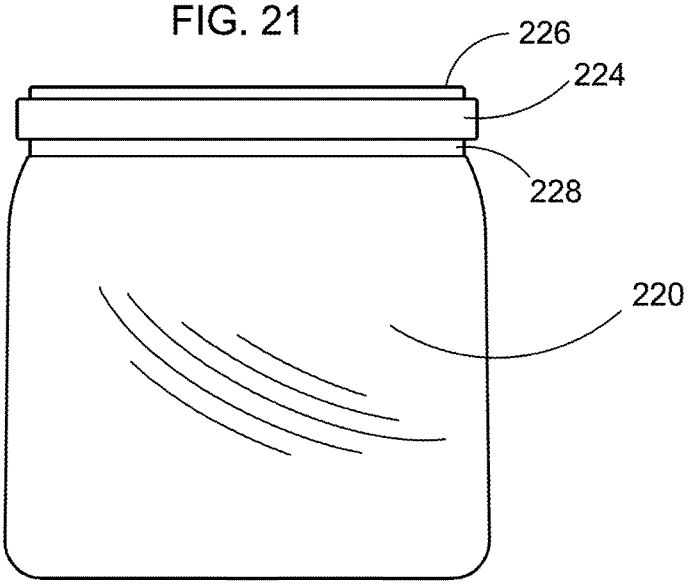
FIG. 22 depicts a side view of the jar illustrating the lid interface rim located at the upper portion of the jar.

FIG. 22 depicts a side view of the jar container 220 illustrating the biometric locking lid interface rim middle portion 224 located at the upper portion of the jar. The biometric locking lid interface rim middle portion 224 has a recessed upper portion 226 and an equally recessed lower portion 228. The upper portion 226 and the biometric locking lid interface rim middle portion 224 both interface with the labyrinth seal lid/jar interfacing gasket 250 with the double bump side portion 252 interfacing with the rim middle portion 224 and the gasket 250 interfacing with the upper portion 226. The resulting seal effectively holds a vacuum pulled within the jar 220.

Figure 23:
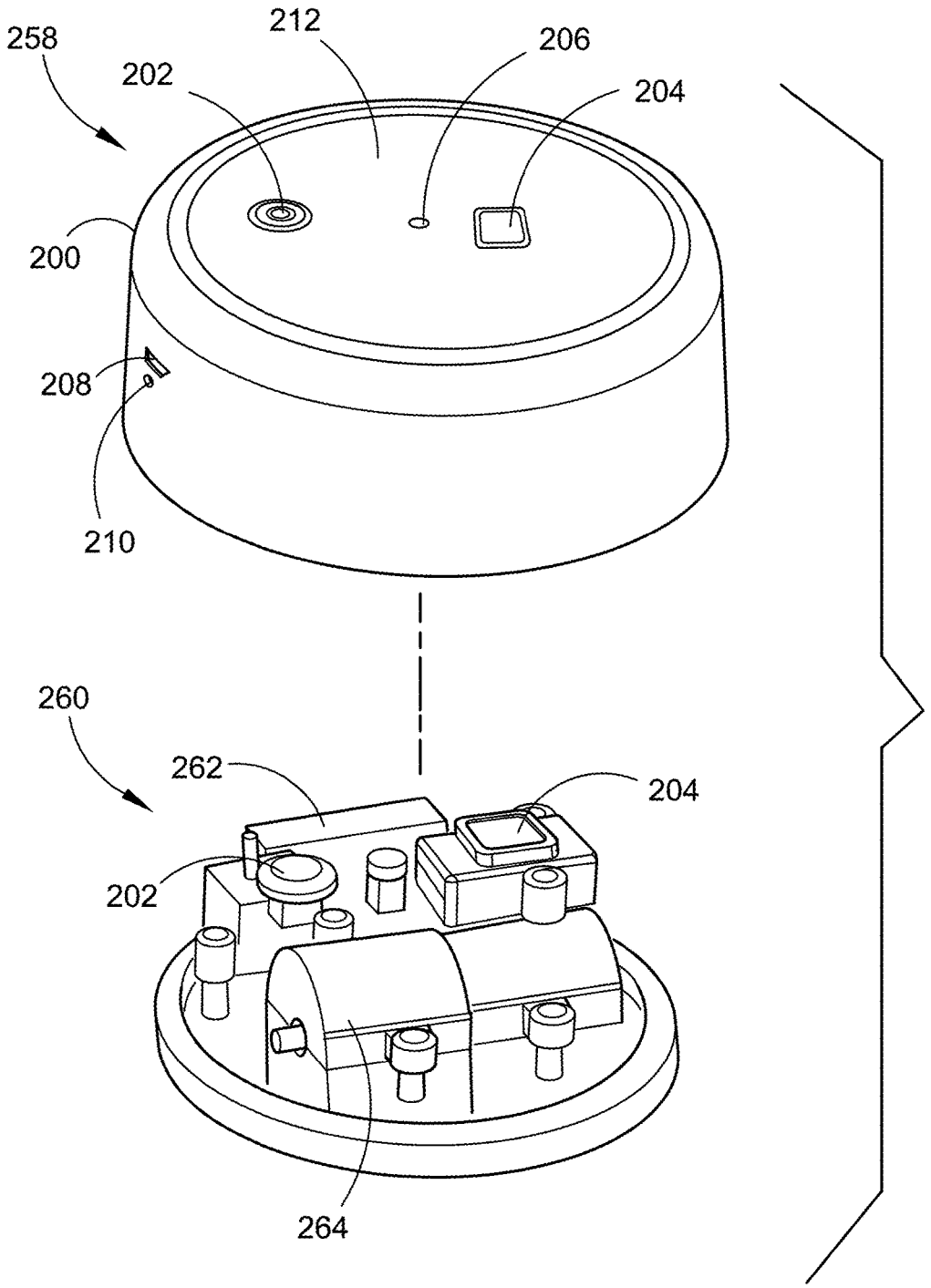
FIG. 23 depicts an exploded view of the lid showing the inner mechanism including the battery and electrically powered vacuum pump components.

FIG. 23 depicts an exploded view of the biometric locking lid 200 with the upper lid cover 258 removed from the inner mechanism frame 260 which supports the battery/CPU microprocessor 262 and vacuum pump 264 components. The biometric locking lid 200 with the upper lid cover 258 includes the upper surface of the lid 212 which has an ON/OFF button 202, a fingerprint enrollment/reader 204, and an indicator LED light 206, as well as the USB charging cord port 208 and an air vent 210 located on the side of the biometric locking lid cover 258. When assembled, the lid cover 258 encloses the inner mechanism frame 260 which supports the battery/CPU microprocessor 262 and vacuum pump 264 components, while also exposing the ON/OFF button 202 and the fingerprint enrollment/reader 204.

Figure 24B:
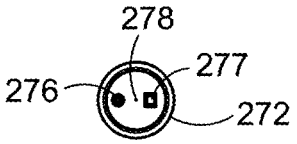
FIG. 24B illustrates a top view of the biometric locking lid on the prescription bottle shown in FIG. 24A.
Figure 24A:
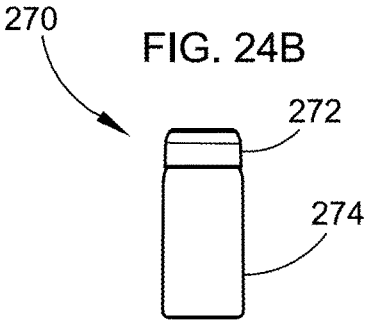
FIG. 24A depicts a prescription bottle having a biometric locking lid thereon.

FIG. 24A depicts a conventional prescription bottle 270 having a biometric locking lid 272, constructed in accordance with the present invention, positioned on top of a conventional prescription pill or medicine container 274 commonly used to dispense and store prescriptions and over the counter medications. The inner components of the fingerprint reader and vacuum pump are miniaturized and housed within the biometric locking lid 272. When the fingerprint reader activates the vacuum pump, a vacuum is pulled within the conventional prescription bottle 274, in accordance with the present invention.

FIG. 24B illustrates a top view of the biometric locking lid 272 on a conventional prescription bottle 270, including an ON/OFF button 276, a fingerprint enrollment/reader 277, and an LED indicator light 278.

Figure 25B:
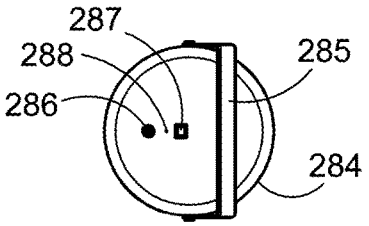
FIG. 25B illustrates a top view of the biometric locking lid on the 5, 10 or 15 gallon pail shown in FIG. 25A.
Figure 25A:
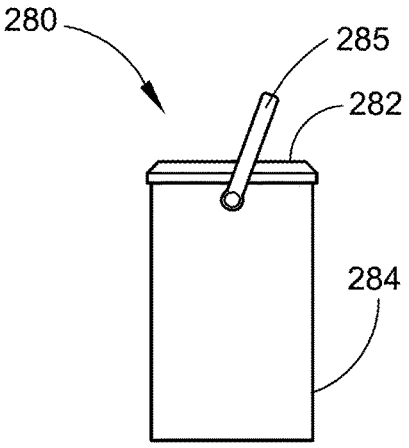
FIG. 25A depicts a 5, 10 or 15 gallon pail having a biometric locking lid thereon.

FIG. 25A depicts a conventional 5, 10 or 15 gallon pail having a biometric locking lid thereon 280. The conventional 5, 10 or 15 gallon pail 284 includes a biometric locking lid 282, a handle 285, an ON/OFF button 286, a fingerprint enrollment/reader 287, and an LED indicator light 288 constructed in accordance with the present invention, positioned on top of a 5, 10 or 15 gallon pail container 284 commonly used today to dispense and store larger volumes of valuable substances that may require securing from unauthorized access. The inner components of the fingerprint reader and vacuum pump are housed within the biometric locking lid 282. When the fingerprint reader activates the vacuum pump, a vacuum is pulled within the conventional 5, 10 or 15 gallon pail 284, in accordance with the present invention.

FIG. 25B illustrates a top view of the biometric locking lid 282, including a handle 285, an ON/OFF button 286, a fingerprint enrollment/reader 287, and an LED indicator light 288.

Figure 26B:
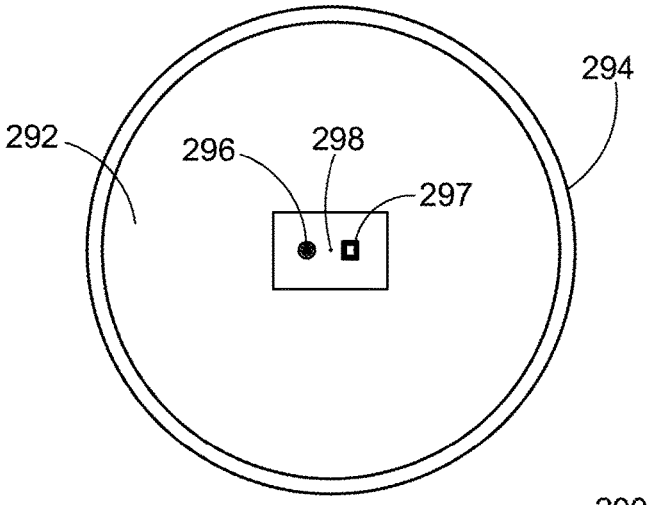
FIG. 26B illustrates a top view of the biometric locking lid on the 50 gallon drum shown in FIG. 26A.
Figure 26A:
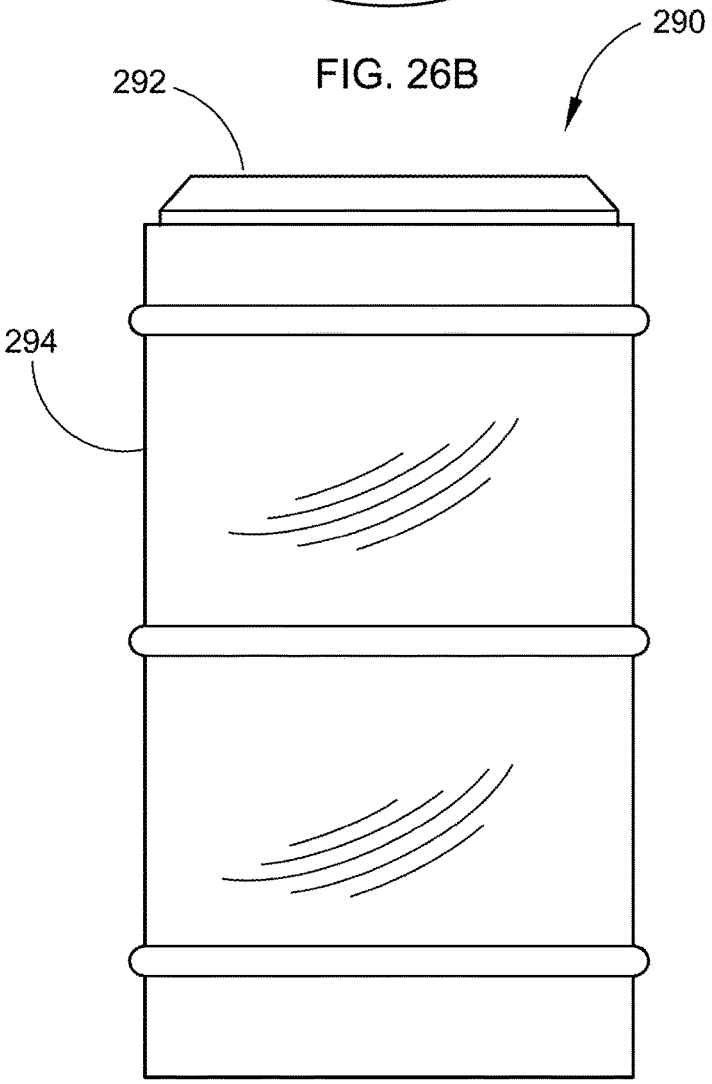
FIG. 26A depicts a 50 gallon drum having a biometric locking lid thereon.

FIG. 26 depicts a 50 gallon drum having a biometric locking lid thereon 290. The conventional 50 gallon drum 294 includes a biometric locking lid 292, constructed in accordance with the present invention, positioned on top of the 50 gallon drum container 294 commonly used today to dispense and store larger volumes of valuable substances that may require securing from unauthorized access. The inner components of the fingerprint reader and vacuum pump are housed within the biometric locking lid 292. When the fingerprint reader activates the vacuum pump, a vacuum is pulled within the conventional 50 gallon drum 294, in accordance with the present invention. FIG. 26B illustrates a top view of the biometric locking lid 292, including an ON/OFF button 296, a fingerprint enrollment/reader 297, and an LED indicator light 298.

Figure 27:
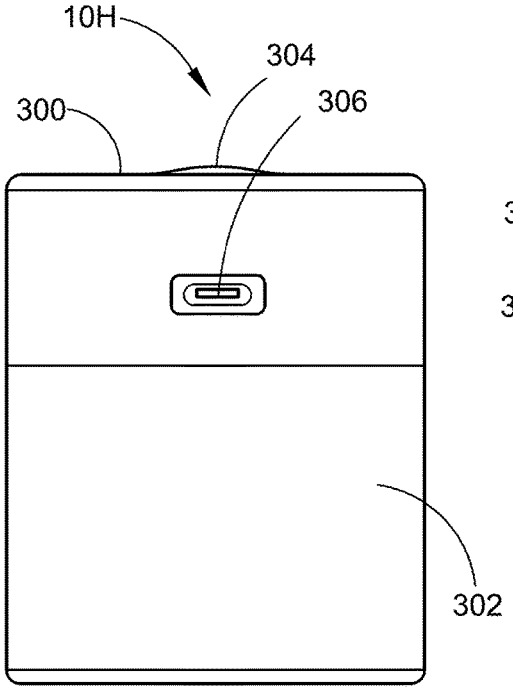
FIG. 27 depicts a front and side elevational view of the Wireless Controlled Locking Jar with Integrated Vacuum Pump container having an lower jar portion and an upper lid portion.

FIG. 27 depicts a front and side elevational view of the Wireless Controlled Locking Jar with Integrated Vacuum Pump 10H container having an upper lid portion 300 and a lower jar portion 302. The upper lid portion 300 has a push button with light emitting diode (LED) 304 on the upper surface of lid portion 300, used for pairing a device such as a smartphone, tablet or the like. The upper lid portion 300 also has a universal serial bus (USB) port 306 used to charge the battery located within the upper lid portion 300 (not shown).

Figure 28:
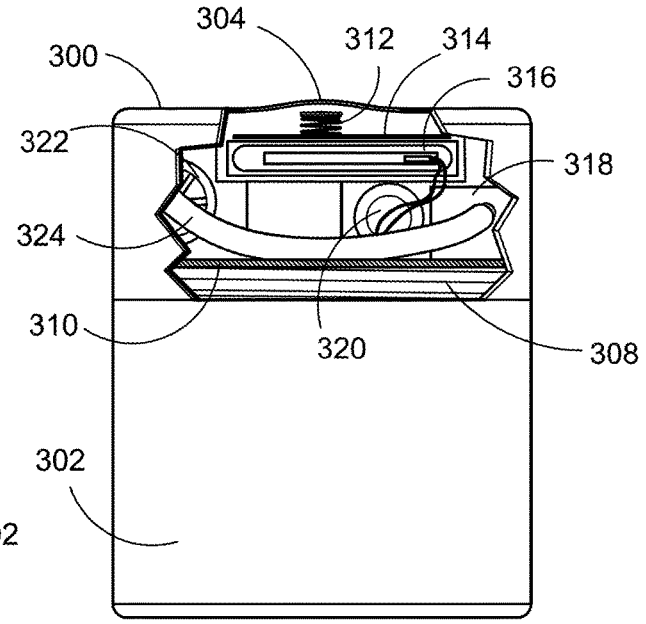
FIG. 28 depicts a front and side elevational view of the Wireless Controlled Locking Jar with Integrated Vacuum Pump container having a lower jar portion and an upper lid portion, illustrating the lid portion partially cut away exposing inner components housed within the lid portion.

FIG. 28 depicts a front and side elevational view of the Wireless Controlled Locking Jar with Integrated Vacuum Pump 10H container having a lower jar portion 302 and an upper lid portion 300, here illustrating the upper lid portion 300 partially cut away exposing numerous inner components housed within the upper lid portion 300. The lower jar portion 302 has a male threaded top 308 which mates with corresponding female threads on the upper lid portion 300. The upper lid portion includes a silicone seal casket 310 which forms an airtight seal when the lid portion 300 and lower jar portion 302 are threaded tightly together. Housed within the upper lid portion 300 are a push button spring 312 located below the push button 304. The push button spring is connected to a printed circuit board 314. A battery 314 power source is located below the printed circuit board 314 and in electrical communication with printed circuit board 314. Also housed within the upper lid portion 300 is a battery 314 powered vacuum pump 320 mounted to a frame 318 which is connected to vacuum hoses 324 and a filter element assembly 322. The filter element assembly 322 acts to filter out debris when pulling a vacuum from the lower jar portion 302, to keep the debris from reaching and contaminating the vacuum pump 320.

Figure 29:
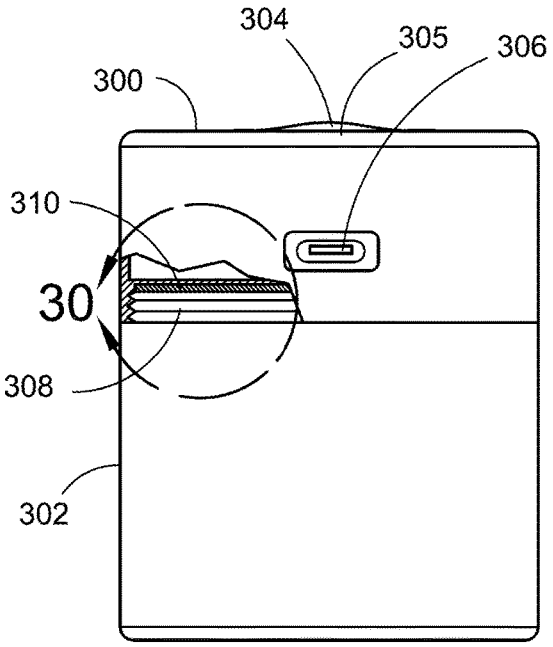
FIG. 29 depicts a front and side elevational view of the Wireless Controlled Locking Jar with Integrated Vacuum Pump container having a lower jar portion and an upper lid portion, illustrating the lid portion partially cut away exposing the threads and gasket which together make an airtight seal.

FIG. 29 depicts a front and side elevational view of the Wireless Controlled Locking Jar with Integrated Vacuum Pump 10H container having a lower jar portion 302 and an upper lid portion 300, illustrating the upper lid portion 300 partially cut away exposing the male threads 308 integral with the lower jar portion 302 and corresponding to the female threads located on the upper lid portion 300 lower section. When threaded together, the upper lid portion 300 and the lower jar portion 302 press against the silicone sealing and gasket 310 which when threaded together make an airtight seal. This airtight seal is what make pulling a vacuum possible when the vacuum pump is activated by the wireless controlling system described below.

Figure 30:
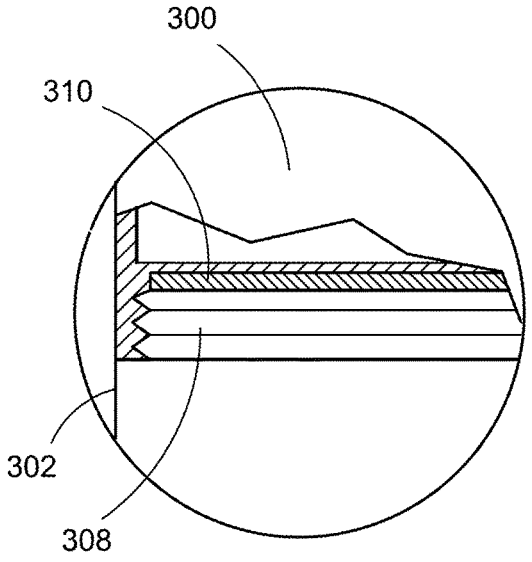
FIG. 30 depicts an enlarged partial cut away side elevational view of the Wireless Controlled Locking Jar with Integrated Vacuum Pump container having a lower jar portion and an upper lid portion, illustrating the lid portion partially cut away exposing the threads and silicone sealing gasket which together make an airtight seal enlarged to show greater detail.

FIG. 30 depicts an enlarged partial cut away side elevational view of the Wireless Controlled Locking Jar with Integrated Vacuum Pump 10H container having a lower jar portion 302 and an upper lid portion 300, illustrating the upper lid portion 300 partially cut away exposing the threads 308 and silicone sealing gasket 310 which together make an airtight seal, enlarged to show greater detail. This airtight seal is what make pulling a vacuum possible when the vacuum pump is activated by the wireless controlling system described below. The vacuum created locks the upper lid portion 300 to the lower jar portion 302, and makes it impossible to open the jar and access the jar's contents without breaking the seal or releasing the vacuum to break the seal.

Figure 31:
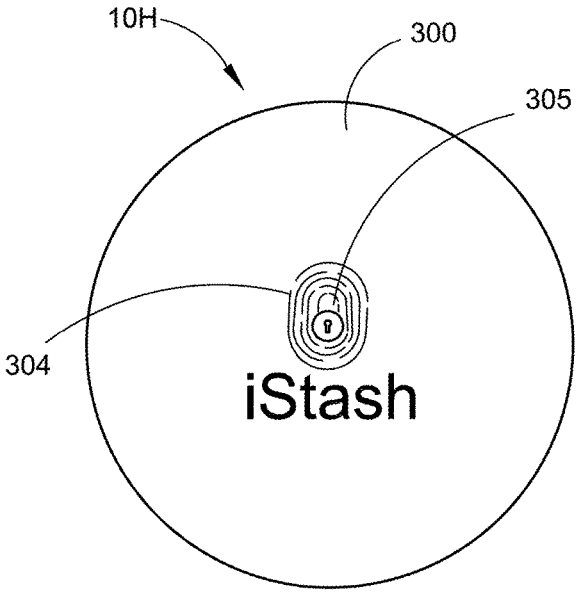
FIG. 31 depicts a top plan view of the Wireless Controlled Locking Jar with Integrated Vacuum Pump container upper lid portion, illustrating the centrally located pairing push button on the top of the outer housing surface of the upper lid portion.

FIG. 31 depicts a top plan view of the Wireless Controlled Locking Jar with Integrated Vacuum Pump 10H container upper lid portion 300, illustrating the centrally located pairing push button 304 on the top of the outer housing surface of the upper lid portion 300. The push button has an integral LED 305 which flashes differing colors depending on the operation occurring within the upper lid portion 300, such as pairing operations and vacuum pump operations.

Figure 32:
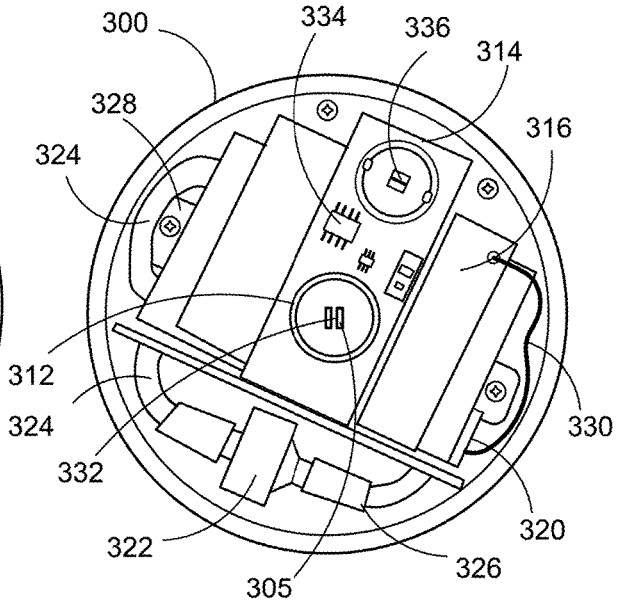
FIG. 32 depicts a top plan cut away view of the Wireless Controlled Locking Jar with Integrated Vacuum Pump container upper lid portion, illustrating the positions of the various components located below the outer housing surface of the upper lid portion.

FIG. 32 depicts a top plan cut away view of the Wireless Controlled Locking Jar with Integrated Vacuum Pump 10H container upper lid portion 300, illustrating the presence and positions of the various components mounted on a frame 328 located below the outer housing surface of the upper lid portion 300. Located on the printed circuit board (PCB) 314 is a push button spring 312 and a push button contact 332 used to activate the pairing operation. The push button contact 332 also has an integral LED to indicate ongoing operational status when pairing operations or vacuum operations are taking place. Also located on the PCB 314 is a central processing unit (CPU) microprocessor 334, and the PCB 314 and CPU microprocessor 334 are powered by the battery 316. The battery 316 is located cradled on frame 328 below the PCB 314 and is in electrical communication with the PCB 314 and the vacuum pump 320 via battery lead wires 330. The vacuum pump has vacuum hoses 324 and 326 which connect the vacuum pump 320 to a filter element assembly 322. The PCB also has a wireless antenna 336 which is controlled by the CPU microprocessor 334.

Figure 33:
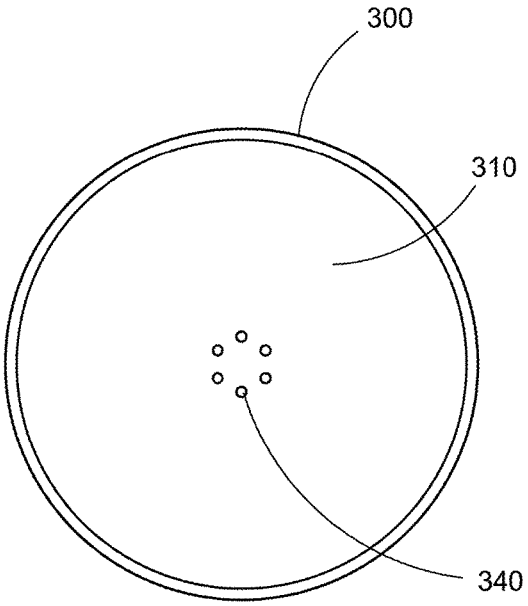
FIG. 33 depicts a bottom view of the Wireless Controlled Locking Jar with Integrated Vacuum Pump container lid portion, illustrating the position of the silicone sealing gasket having a plurality of vent orifices located on the bottom of the outer housing surface of the lid portion.

FIG. 33 depicts a bottom view of the Wireless Controlled Locking Jar with Integrated Vacuum Pump 10H container lid portion, illustrating the position of the silicone sealing gasket 310 having a plurality of vent orifices 340. The silicone seal gasket 310 is located on the bottom of the outer housing surface of the lid portion 300. The plurality of vent orifices 340 are located centrally on the gasket 310 and allow air to pass through the gasket where located. These vent orifices 340 act as vacuum air and release air transfer points between the lower jar portion 302 and the vacuum pump 320 in the upper lid portion 300. In this way, air is removed from the lower jar portion 302 when a vacuum is being pulled, and air is released into the vacuum within the lower jar portion when the vacuum lock is being unlocked and released for opening the jar.

Figure 34:
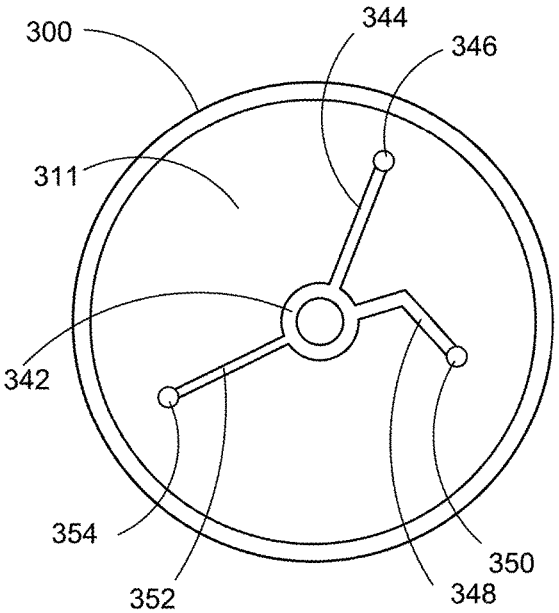
FIG. 34 depicts a bottom view of the Wireless Controlled Locking Jar with Integrated Vacuum Pump container lid portion, illustrating the outer housing surface below the silicone sealing gasket having a plurality of carved out vent channels located on the bottom of the outer housing surface of the lid portion.

FIG. 34 depicts a bottom view of the Wireless Controlled Locking Jar with Integrated Vacuum Pump 10H container upper lid portion 300, illustrating the outer housing surface directly below the silicone sealing gasket here removed to expose the detail below the gasket) central circular vent channel 342 having a plurality of carved out vent channels 344, 348 and 352 radiating outward from the central circular vent channel 342, located on the bottom of the outer housing surface of the lid portion 311. At the distal end of each of the radiating vent channels 344, 348 and 352 are orifices 346, 350 and 354, respectively. These orifices are in communication with the vacuum pump hoses 324 and 326 and the vacuum pump 320 pulls air from the lower jar portion 302 through these orifices 346, 350 and 354, and radiating vent channels 344, 348 and 352. The vent orifices 340 located through the silicone seal gasket 310 are located directly above the circular vent channel 342. This configuration of orifices vents and vent channels allows air to be removed (locked) or released back into the lower jar portion (unlocked) by operation of the vacuum pump. In operation, when the vacuum pump 320 is activated, air is forced out of the lower jar portion 302 through the vent orifices 340 in the silicone seal gasket 310, through the circular vent channel carved out in the inner surface 311 of the upper lid portion 300, through the radiating vent channels 344, 348 and 352, and to the vent orifices 346, 350 and 352 on the distal ends of the radiating vent channels, then into the vacuum pump hoses, and is expelled.

Figure 35:
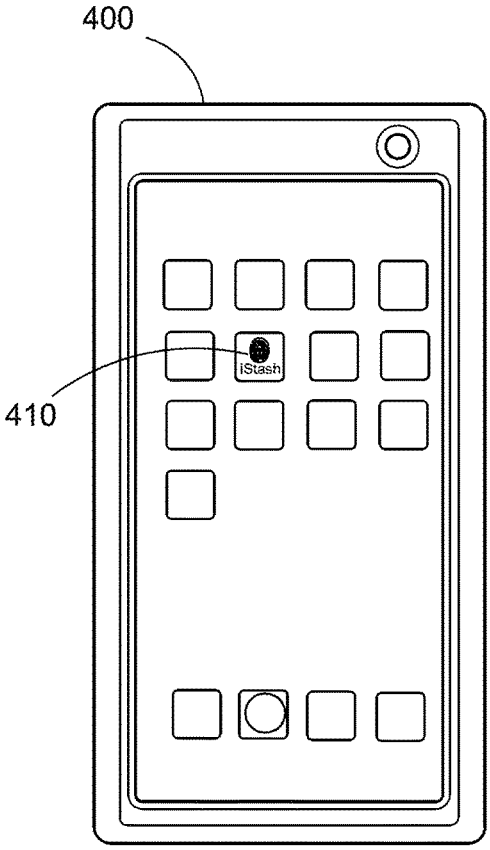
FIG. 35 depicts a smartphone having a Wireless Controlled Locking Jar with Integrated Vacuum Pump software application (APP) installed and showing the iStash APP icon within an array of various software application icons on the smartphone screen.

FIG. 35 depicts a smartphone 400 having a Wireless Controlled Locking Jar with Integrated Vacuum Pump 10H software application (APP) installed and showing the iStash APP icon 410 within an array of various software application icons on the smartphone 400 screen. In order to start the APP, a user would push the iStash icon 410.

Figure 36:
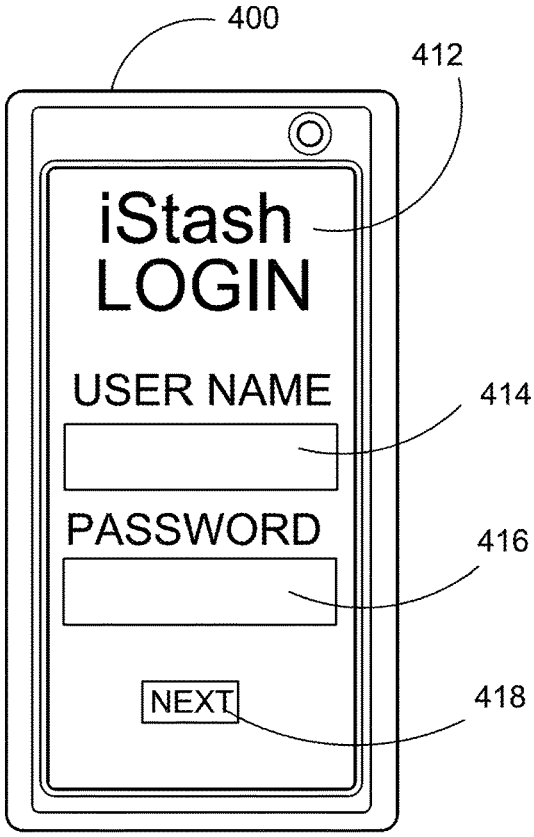
FIG. 36 depicts a smartphone displaying the Wireless Controlled Locking Jar with Integrated Vacuum Pump software APP user iStash login screen after having pushed the iStash APP icon of FIG. 35.

FIG. 36 depicts a smartphone 400 displaying the Wireless Controlled Locking Jar with Integrated Vacuum Pump 10H software APP user iStash login screen 412 after having pushed the iStash APP icon 410 of FIG. 35. Once on this login screen 412, a user would enter the user name in box 414 and a password in box 416, then push the next button 418 to log in to the smartphone iStash APP.

Figure 37:
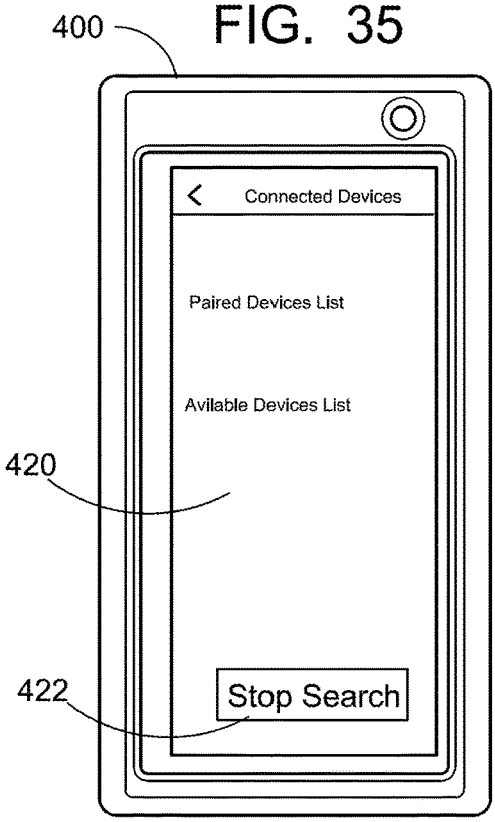
FIG. 37 depicts a smartphone displaying the Wireless Controlled Locking Jar with Integrated Vacuum Pump software APP user iStash connected devices list, paired devices, and available devices search screen.

FIG. 37 depicts a smartphone 400 displaying the Wireless Controlled Locking Jar with Integrated Vacuum Pump 10H software APP user iStash connected devices and wireless pairing devices screen 420, showing any wireless paired devices thereon, and an available devices search button 422. Once logged in to the APP, any previously wireless paired devices will automatically connect wirelessly via Wi-Fi and or Bluetooth and be shown on the wireless paired devices list. Additionally, any non-paired wireless devices available to be wireless paired with the Wireless Controlled Locking Jar with Integrated Vacuum Pump 10H will show up on the Available Devices list. To wireless pair a Wireless Controlled Locking Jar with Integrated Vacuum Pump 10H, a user pushes down on the push button 304 and the LED 305 integral to push button 304 will begin to flash. Once wirelessly paired, the LED 305 will stop flashing. Now that the Wireless Controlled Locking Jar with Integrated Vacuum Pump 10H has been wirelessly paired to a smartphone, tablet or like device, it will respond to the lock and unlock command buttons (see FIG. 38 below).

Figure 38:
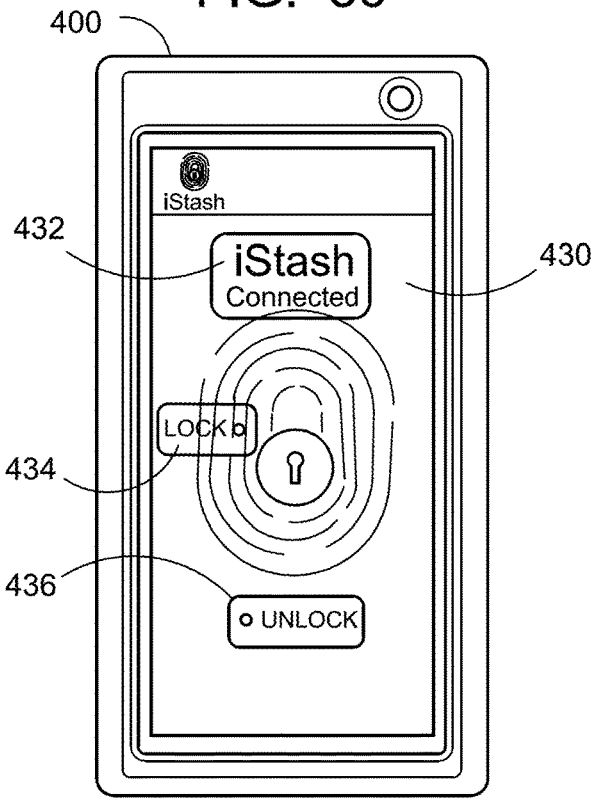
FIG. 38 depicts a smartphone displaying the Wireless Controlled Locking Jar with Integrated Vacuum Pump software APP user iStash connected status screen having a lock and unlock button thereon.

FIG. 38 depicts a smartphone 400 displaying the Wireless Controlled Locking Jar with Integrated Vacuum Pump 10H software APP user iStash connected status screen 430 showing the iStash connection status 432 button, and having a lock button 434 and an unlock button 436 thereon. Once connection status is established, the lock button 434 can be pushed to activate the vacuum pump 320 located within the wireless paired Wireless Controlled Locking Jar with Integrated Vacuum Pump 10H to pull a vacuum within the lower jar portion 302 of the container. While the vacuum pump is in operation pulling a vacuum, the LED 305 will be flashing. Once a vacuum is pulled and established within the lower jar portion 302, it is impossible to open the container and access the contents within the container. Alternatively, the unlock button 436 may be pushed to release an existing vacuum from the lower jar portion 302, in that pushing the unlock button 436 releases the air back into the lower jar portion 302 and breaks the vacuum seal allowing a user to readily open the container by untreading the upper lid portion 300 from the lower jar portion 302.

The Biometric Locking Cannabis/Pill Containers 10A, 10B, 10C, 10D 10E, 10F, 10G and the Wireless Controlled Locking Jar with Integrated Vacuum Pump 10H shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing a Biometric Locking Cannabis/Pill Containers 10A, 10B, 10C, 10D, 10E 10F and the Biometric Locking Jar with Integrated Vacuum Pump 10G in accordance with the spirit of this application, and such changes, alternations and modifications as would occur to those skilled in the art are considered to be within the scope of this application as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "night," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A wireless controlled locking jar with integrated vacuum pump comprising:

(a) an upper lid portion having a upper surface and a lower surface wherein said upper lid portion houses a vacuum pump, vacuum pump hoses, a filter element assembly, a power source, a printed circuit board (PCB), a central processing unit (CPU) microprocessor configured to control said vacuum pump, and a wireless antenna;

(b) a lower jar portion having an upper section and a lower section and further wherein said upper section includes male threads and said lower section comprises a contents container jar;

(c) further wherein said lower surface of the upper lid portion includes a silicone sealing gasket and female threads which are configured to mate with said male threads on said upper section of said lower jar portion; and (d) a smartphone software application (APP) configured to allow wireless pairing with said CPU microprocessor with a smartphone;

wherein when said APP is used to pair said CPU microprocessor configured to control said vacuum pump to a smartphone, said vacuum pump can be activated to pull a vacuum within said lower jar portion and securely locks said upper lid portion to said lower jar portion until the vacuum is released by further controlling said vacuum pump.

2. The wireless controlled locking jar with integrated vacuum pump according to claim 1, wherein said upper lid portion having the upper surface and the lower surface includes a push button on said upper surface wherein said push button is configured to initiate the wireless pairing.

3. The wireless controlled locking jar with integrated vacuum pump according to claim 2, wherein said vacuum pump which is CPU microprocessor controlled further includes a universal serial bus USB charging port and both said CPU microprocessor and said vacuum pump are electrically powered and in electrical communication with said USB charging port and said power source.

4. The wireless controlled locking jar with integrated vacuum pump according to claim 3, wherein said power source includes a battery and said battery is charged via said USB charging port.

5. The wireless controlled locking jar with integrated vacuum pump according to claim 2, wherein said push button includes an integrated indicator light emitting diode (LED).

6. The wireless controlled locking jar with integrated vacuum pump according to claim 1, wherein said silicone seal gasket creates an airtight seal between said upper lid portion and said lower jar portion when said male threads are mated with said female threads and tightened down.

7. The wireless controlled locking jar with integrated vacuum pump according to claim 1, wherein said silicone seal gasket includes a plurality of orifices therein which allow air to be pumped out of said lower jar portion thereby creating said vacuum, and allow air to be returned to said lower jar portion to release the vacuum within the lower jar portion.

8. The wireless controlled locking jar with integrated vacuum pump according to claim 1, wherein said upper lid portion includes a plurality of vent channels and vent orifices in communication with said vacuum pump hoses and said vacuum pump, which allows said vacuum pump to pull said vacuum within said lower section of the lower jar portion.

9. The wireless controlled locking jar with integrated vacuum pump according to claim 1, wherein said wireless antenna is configured to allow wireless pairing of said CPU microprocessor with the smartphone using the smartphone software application APP configured to control said vacuum pump after said CPU microprocessor and said smartphone are paired and in wireless communication.

10. The wireless controlled locking jar with integrated vacuum pump according to claim 1, wherein said smartphone software application APP is configured to allow wireless controlling of said vacuum pump to lock and unlock said upper lid portion to said lower jar portion.

11. A method for making a wireless controlled locking jar with integrated vacuum pump, comprising the steps of:

(a) providing an upper lid portion having a upper surface and a lower surface wherein said upper lid portion houses a vacuum pump, vacuum pump hoses, a filter element assembly, a power source, a printed circuit board (PCB), a central processing unit (CPU) microprocessor configured to control said vacuum pump, and a wireless antenna, (b) providing a lower jar portion having an upper section and a lower section and further wherein said upper section includes male threads and said lower section comprises a contents container jar, (c) further providing said lower surface of the upper lid portion including a silicone sealing gasket and female threads which are configured to mate with said male threads on said upper section of said lower jar portion; and (d) providing a smartphone software application (APP) configured to allow wireless pairing with said CPU microprocessor with a smartphone;

wherein when said APP is used to pair said CPU microprocessor configured to control said vacuum pump to a smartphone, said vacuum pump can be activated to pull a vacuum within said lower jar portion and securely locks said upper lid portion to said lower jar portion until the vacuum is released by further controlling said vacuum pump.

12. The method for making a wireless controlled locking jar with integrated vacuum pump according to claim 11, wherein said upper lid portion having the upper surface and the lower surface includes a push button on said upper surface wherein said push button is configured to initiate the wireless pairing.

13. The method for making a wireless controlled locking jar with integrated vacuum pump according to claim 12, wherein said vacuum pump which is CPU microprocessor controlled further includes a universal serial bus USB charging port and both said CPU microprocessor and said vacuum pump are electrically powered and in electrical communication with said USB charging port and said power source.

14. The method for making a wireless controlled locking jar with integrated vacuum pump according to claim 13, wherein said power source includes a battery and said battery is charged via said USB charging port.

15. The method for making a wireless controlled locking jar with integrated vacuum pump according to claim 11, wherein said silicone seal gasket creates an airtight seal between said upper lid portion and said lower jar portion when said male threads are mated with said female threads and tightened down.

16. The method for making a wireless controlled locking jar with integrated vacuum pump according to claim 11, wherein said silicone seal gasket includes a plurality of orifices therein which allow air to be pumped out of said lower jar portion thereby creating said vacuum, and allow air to be returned to said lower jar portion to release the vacuum within the lower jar portion.

17. The method for making a wireless controlled locking jar with integrated vacuum pump according to claim 11, wherein said upper lid portion includes a plurality of vent channels and vent orifices in communication with said vacuum pump hoses and said vacuum pump, which allows said vacuum pump to pull said vacuum within said lower section of the lower jar portion.

18. The method for making a wireless controlled locking jar with integrated vacuum pump according to claim 11, wherein said wireless antenna is configured to allow wireless communication pairing of said CPU microprocessor with the smartphone using the smartphone software application APP configured to control said vacuum pump after said CPU microprocessor and said smartphone are paired and in wireless communication.

19. The method for making a wireless controlled locking jar with integrated vacuum pump according to claim 11, wherein said smartphone software application APP is configured to allow wireless controlling of said vacuum pump to lock and unlock said upper lid portion to said lower jar portion.

20. A method for using a wireless controlled locking jar with integrated vacuum pump, comprising the steps of:

(a) providing an upper lid portion having a upper surface and a lower surface wherein said upper lid portion houses a vacuum pump, vacuum pump hoses, a filter element assembly, a power source, a printed circuit board (PCB), a central processing unit (CPU) microprocessor configured to control said vacuum pump, and a wireless antenna;

(b) providing a lower jar portion having an upper section and a lower section and further wherein said upper section includes male threads and said lower section comprises a contents container jar;

(c) further providing said lower surface of the upper lid portion including a silicone sealing gasket and female threads which are configured to mate with said male threads on said upper section of said lower jar portion; and (d) providing a smartphone software application (APP) configured to allow (d) wireless pairing with said CPU microprocessor configured to control said vacuum pump to a smartphone for the purpose of controlling said vacuum pump;

(e) pairing said CPU microprocessor configured to control said vacuum pump with the smartphone using said smartphone software application (APP);

(f) using said smartphone software application (APP) paired to said CPU microprocessor configured to control said vacuum pump to turn on and activate said vacuum pump to pull a vacuum within said lower jar portion; and (g) pulling the vacuum to securely lock said upper lid portion to said lower jar portion until the vacuum is released by further controlling said vacuum pump using said smartphone software application (APP) paired to said CPU microprocessor configured to control said vacuum pump.

* * * * *